US009482003B2

(12) United States Patent
Browning et al.

(10) Patent No.: US 9,482,003 B2
(45) Date of Patent: Nov. 1, 2016

(54) INSULATED CONCRETE MASONRY SYSTEM

(71) Applicant: Oldcastle Architectural, Inc., Atlanta, GA (US)

(72) Inventors: Leonard Browning, Aurora, IL (US); Robert J. Lundell, Stillwater, MN (US); Stephane Beliveau, Anjou, CA (US)

(73) Assignee: Oldcastle Architectural, Inc., Atlanta, GA (US)

( * ) Notice: Subject to any disclaimer, the term of this patent is extended or adjusted under 35 U.S.C. 154(b) by 0 days.

(21) Appl. No.: 14/212,012

(22) Filed: Mar. 14, 2014

(65) Prior Publication Data

US 2014/0260029 A1 Sep. 18, 2014

Related U.S. Application Data

(60) Provisional application No. 61/791,187, filed on Mar. 15, 2013.

(51) Int. Cl.
*E04C 1/00* (2006.01)
*E04C 1/41* (2006.01)
(Continued)

(52) U.S. Cl.
CPC . *E04C 1/41* (2013.01); *E04B 2/18* (2013.01); *E04B 2/26* (2013.01); *E04C 1/397* (2013.01);
(Continued)

(58) Field of Classification Search
CPC ..... E04C 1/141; E04C 1/40; E04B 2/18; E04B 2/26; E04B 2002/0234; E04B 2002/0247; E04B 2002/0236; E04B 2002/0252; E04B 2/8641; E04B 2002/8676; E04B 2002/0239; E04B 1/3205; E04B 1/3211
USPC ..... 52/309.4, 309.9, 309.11, 309.12, 52/309.14, 309.17, 379, 404.2, 405.2, 52/563–565, 586.2, 590.1, 590.2, 604
See application file for complete search history.

(56) References Cited

U.S. PATENT DOCUMENTS 2,185,335 A * 1/1940 Fischer ..... 52/426
2,518,640 A * 8/1950 Purinton ..... 52/285.1
(Continued)

FOREIGN PATENT DOCUMENTS

DE 29602716 6/1996
DE 202009002697 5/2009
(Continued)

OTHER PUBLICATIONS

ASTM International, Loadbearing Concrete Masonry Units, Standard Specification, Designation C90-14, downloaded Feb. 25, 2015, 4 pages.
(Continued)

*Primary Examiner* — Brian Mattei
(74) *Attorney, Agent, or Firm* — Kilpatrick Townsend & Stockton LLP

(57) ABSTRACT

A insulated masonry wall system having insulation blocks between structural and face blocks to provide structures that are strong, inexpensive, avoid thermal bridges, and resist transmission of heat. The walls are attractive and versatile, and an enormous variety of decorative face members may be utilized. The face blocks are attached to the structural blocks to prevent facing materials from falling even if fire destroys the insulation blocks between the structural blocks and the facing. The system resists water penetration and effectively drains water that does penetrate any portion of the system.

28 Claims, 25 Drawing Sheets

(51) Int. Cl.

| | |
|---|---|
| ***E04B 2/18*** | (2006.01) |
| ***E04C 1/39*** | (2006.01) |
| ***E04B 2/26*** | (2006.01) |
| *E04B 2/02* | (2006.01) |

(52) U.S. Cl.

CPC *E04B 2002/0234* (2013.01); *E04B 2002/0236* (2013.01); *E04B 2002/0247* (2013.01); *E04B 2002/0252* (2013.01); *E04B 2002/0276* (2013.01)

(56) References Cited

U.S. PATENT DOCUMENTS

| | | | | |
|---|---|---|---|---|
| 2,687,034 | A * | 8/1954 | Blanc | E04B 2/18 52/396.08 |
| 2,919,572 | A * | 1/1960 | Salzi | 52/381 |
| 3,873,225 | A * | 3/1975 | Jakobsen et al. | 404/41 |
| 4,190,995 | A | 3/1980 | Armistead | |
| 4,557,094 | A * | 12/1985 | Beliveau | 52/405.4 |
| 4,622,796 | A * | 11/1986 | Aziz et al. | 52/747.12 |
| 4,698,947 | A * | 10/1987 | McKay | E04B 2/8641 52/309.11 |
| 4,854,097 | A | 8/1989 | Haener | |
| 5,209,037 | A * | 5/1993 | Kennedy et al. | 52/309.12 |
| 5,566,518 | A * | 10/1996 | Martin et al. | 52/426 |
| 5,983,585 | A | 11/1999 | Spakousky | |
| 6,148,576 | A * | 11/2000 | Janopaul, Jr. | 52/426 |
| 6,189,282 | B1 * | 2/2001 | VanderWerf | 52/582.1 |
| 6,305,135 | B1 * | 10/2001 | Inaba | 52/309.12 |
| 6,978,581 | B1 | 12/2005 | Spakousky | |
| 2007/0294970 | A1 * | 12/2007 | Marshall et al. | 52/309.11 |
| 2008/0104916 | A1 * | 5/2008 | Schmid | 52/405.2 |
| 2009/0041552 | A1 | 2/2009 | Hammer | |
| 2009/0288361 | A1 * | 11/2009 | Badin | 52/589.1 |
| 2010/0101159 | A1 * | 4/2010 | Gleeson et al. | 52/105 |
| 2011/0000161 | A1 * | 1/2011 | Aube et al. | 52/563 |
| 2012/0073226 | A1 * | 3/2012 | Biggin et al. | 52/309.4 |
| 2012/0247042 | A1 * | 10/2012 | Clancy et al. | 52/309.4 |
| 2014/0150361 | A1 | 6/2014 | Castonguay et al. | |

FOREIGN PATENT DOCUMENTS

| | | |
|---|---|---|
| EP | 0003268 | 8/1979 |
| EP | 1479841 | 11/2004 |
| EP | 2226444 | 9/2010 |
| FR | 2372940 | 6/1978 |
| FR | 2567177 | 10/1986 |
| WO | 2004072400 | 8/2004 |

OTHER PUBLICATIONS

International Preliminary Report on Patentability from related PCT Application No. PCT/US2014/028784, dated Sep. 24, 2015, 8 pages.

International Search Report and Written Opinion in related International Application No. PCT/US2014/028784, dated Sep. 26, 2014, 12 pages.

* cited by examiner

INSULATED CONCRETE MASONRY SYSTEM

CROSS REFERENCE TO RELATED APPLICATION

This application claims priority to U.S. Provisional Patent application Ser. No. 61/791,187 for "Insulated Block Wall System," filed Mar. 15, 2013, which is incorporated herein by reference.

FIELD OF THE INVENTION

This patent relates to concrete and other masonry blocks, walls and other structures and, more specifically, to such structures that contain insulation and utilize facing materials.

BACKGROUND OF THE INVENTION

Masonry walls and similar structures have been made with a wide variety of construction materials and methods and therefore exhibit a large number of different characteristics. Among such walls, precast concrete block walls are well known. While precast concrete block or CMU (concrete masonry unit) walls are inexpensive and strong, conventional such walls provide relatively little resistance to heat transmission, may drain water poorly and are often unattractive.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

This invention provides complementary components for the construction of clad, faced or other masonry walls and similar structures that are strong, inexpensive, avoid thermal bridges, resist transmission of heat, and are attractive and versatile because an enormous variety of decorative face members may be utilized. Moreover, embodiments of this invention effectively drain water while resisting penetration of the entire structure by water and provide structures that prevent facing materials from falling even if fire destroys insulating foam between the structural block and the facing. They may also present attractive systems in seismic properties and resistance to wind loading.

The wall and other structures components and system of this invention include anchoring components that physically connect face materials to structural materials that are separated from the face materials by heat insulation and, generally, without undesirable thermal bridges. The components and system provide anchors that are coated with or imbedded in thermal insulation materials such as expanded polystyrene foams or a wide variety of other plastic or polymeric materials. Alternatively, the anchors may be fabricated from materials or combinations of materials (including, without limitation, materials coated with a thermal insulating coating) that themselves do not efficiently transmit heat and thereby avoid undesirable thermal bridges. Such materials may include, without limitation, basalt fibers, ceramic fibers, glass fibers or carbon fibers and other compatible and appropriate composite materials.

The anchoring components of this invention may have a wide variety of shapes and structures for anchoring face materials to structural wall or other building materials across or through thermal insulation. Generally such anchors will maintain connections between building structure and face materials even if fire or other destructive seismic and other events damage or destroy insulation between the face materials and building structure so that such destructive events do not cause face materials to detach and fall. Generally such anchors have anchor ends that are captured in or otherwise attached to the face materials and structural materials. Such connections may include bulbous, spread, cap-like, plate-like, bent, threaded or other anchor ends that are captured in slots, grooves, threaded members or the like. Such receiving structures can include T-slots, dovetail slots or other anchor-engaging structures, and such slots or structures can open above and or below the assembled location of the anchor, such as one or two edges of the structural material or face material. "Key-hole" slots are also usable that have an opening large enough for the anchor end to be inserted in a space that communicates with space partially covered by a structure defining a narrower slot through which a smaller portion of the anchor can extend. Anchor-to-facing or anchor-to-structure connections can simply slide together, can have "insert and slide" structure, can have an "engage and turn" structure, and can include threaded components (including, without limitation, threaded male members like screws and bolts and threaded female members like nuts) among other alternatives.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
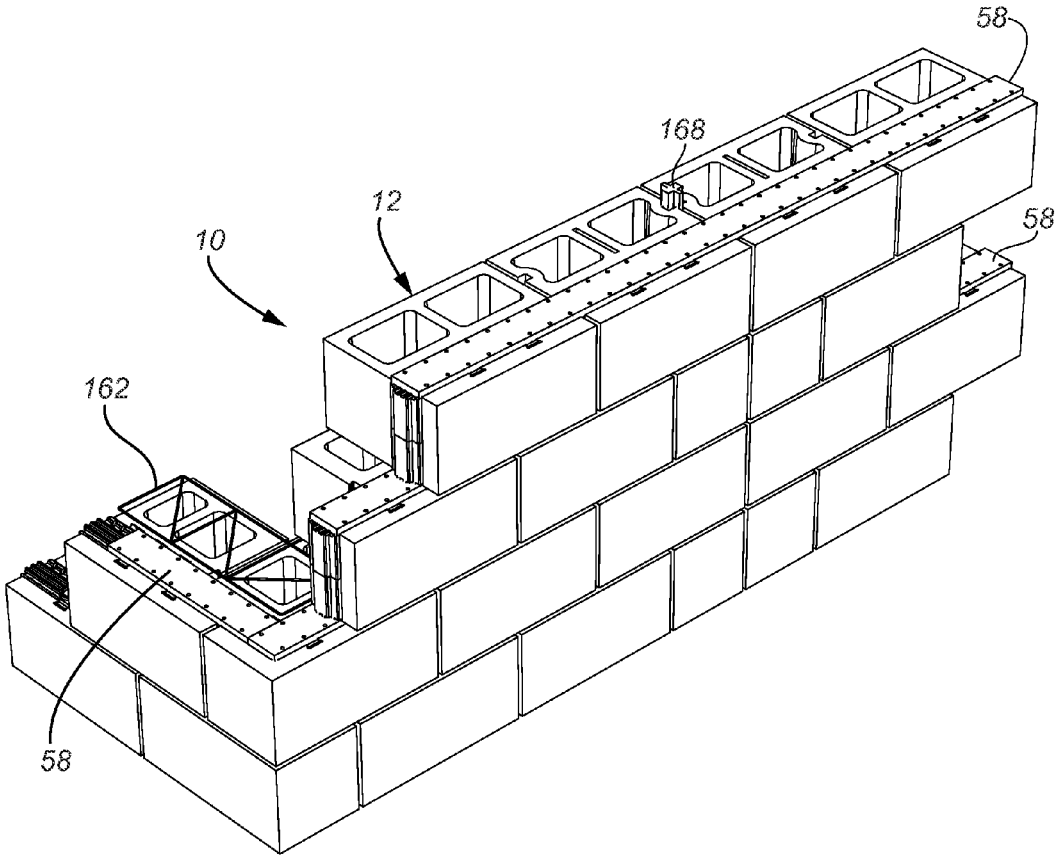
FIG. 1 is a perspective view of a first exemplary embodiment of assembled structural block, insulation and facing components of the concrete masonry system of this invention.
Figure 2:
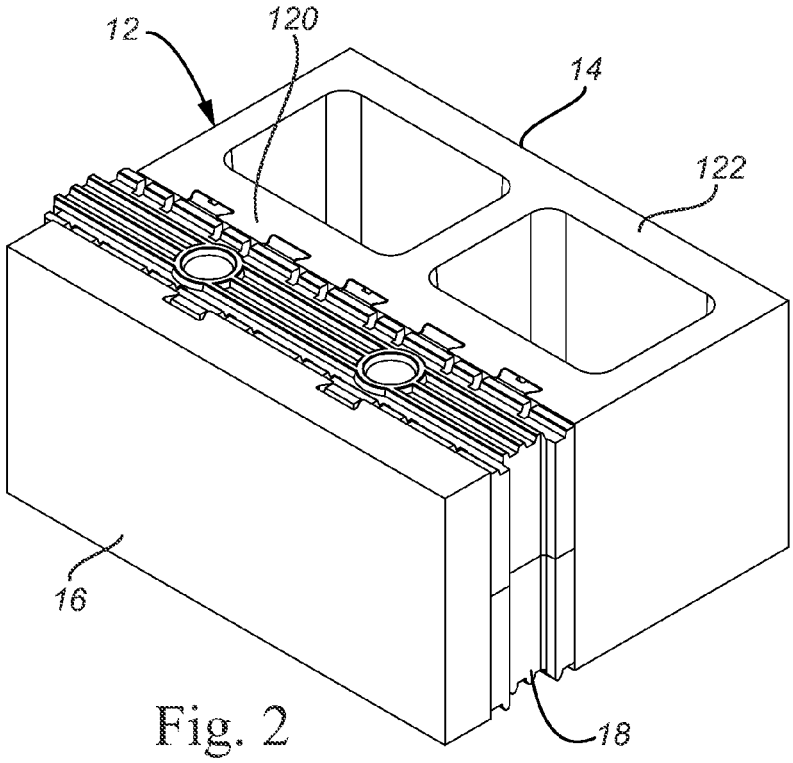
FIG. 2 is a perspective view of an exemplary stretcher sub-assembly of this invention.

A basic block wall assembly 10 of a first embodiment of the insulated block system of this invention is depicted in FIG. 1. It includes an insulated stretcher block sub-assembly 12 (also shown in FIG. 2), together with other blocks, reinforcement and gasket material further described below.

Figure 11:
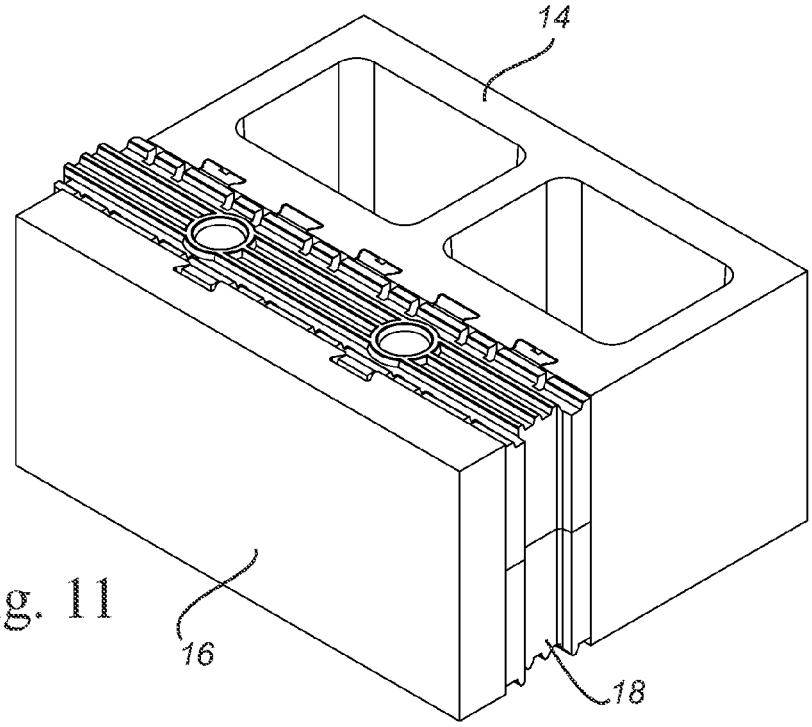
FIG. 11 is an enlarged perspective view of the exemplary stretcher unit of this invention shown in FIG. 2.
Figure 12:
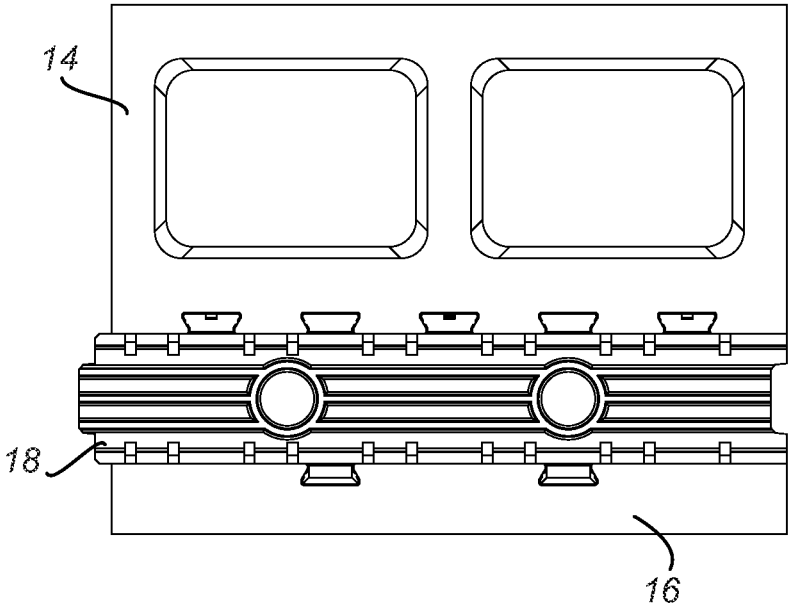
FIGS. 12 and 13 are top and right end views of the stretcher unit shown in FIG. 11.
Figure 13:
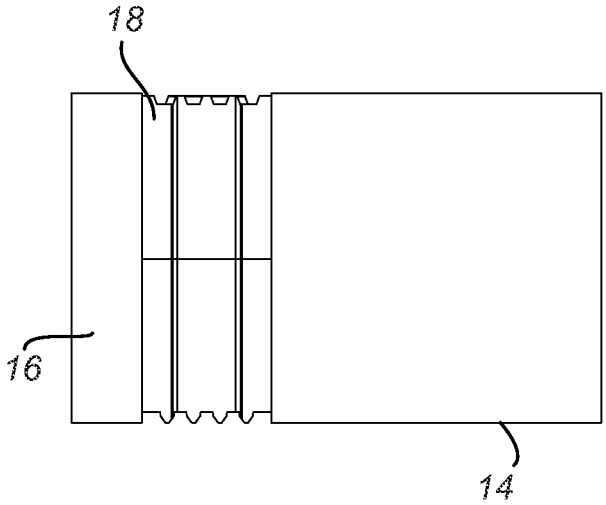

Each insulated block assembly is assembled from three components, a structural block, a facing block, and insulation block between these. The insulated stretcher block 12 depicted in FIGS. 11, 12 and 13 incorporates an insulation block 18 containing anchors 20 and sandwiched between a structural stretcher block 14 and a facing block or facing 16.

As will be appreciated by review of the Figures, the exemplary components depicted in the Figures are consistent in size and relative proportions such as height as compared to length and depth. Components of different sizes than those depicted in the Figures and components with different proportions are easily designed and manufactured utilizing the information provided here. For instance, among many other possibilities, a system of this invention may be produced with structural, insulation and facing blocks nominally one-half as tall as the components illustrated in the Figures as compared to length and depth. Numerous other relative proportions are likewise easily utilized.

Details of the structures of the exemplary components of exemplary stretcher block assembly 12 are well depicted in FIGS. 14-22.

Figure 14:
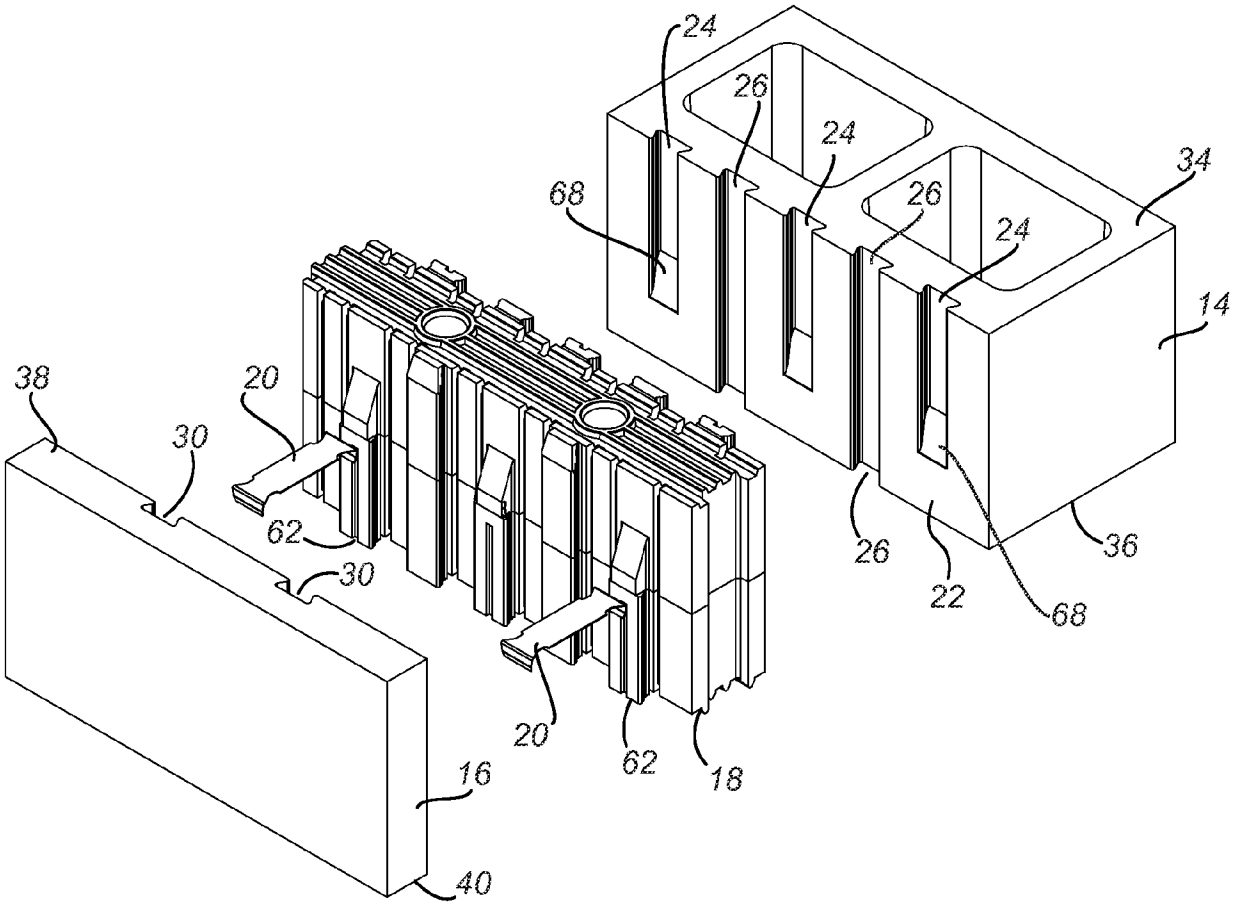
FIG. 14 is an exploded perspective view of the stretcher unit shown in FIG. 11.
Figure 15:
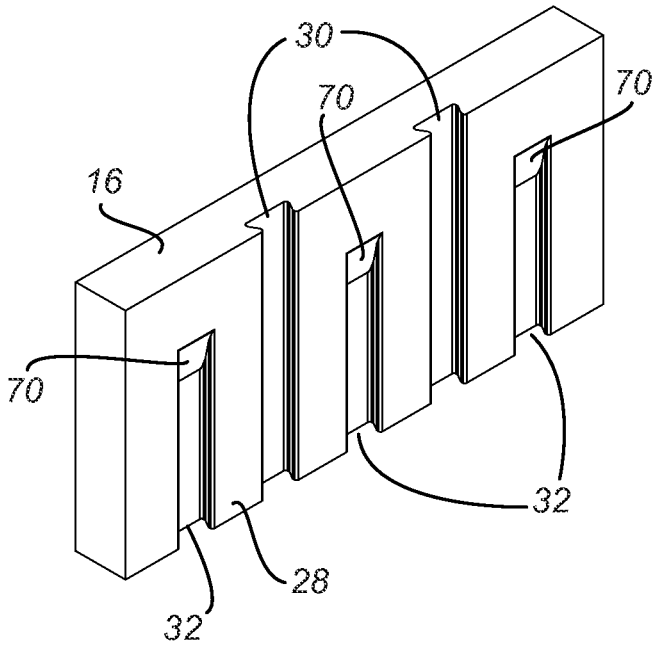
FIG. 15 is a perspective view of the top, left, end and back of the exemplary facing shown in FIG. 14.
Figure 16:
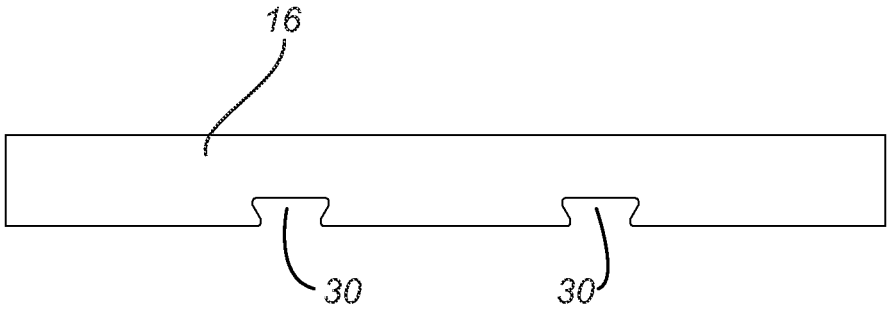
FIG. 16 is a top view of the facing of FIG. 15.
Figure 17:
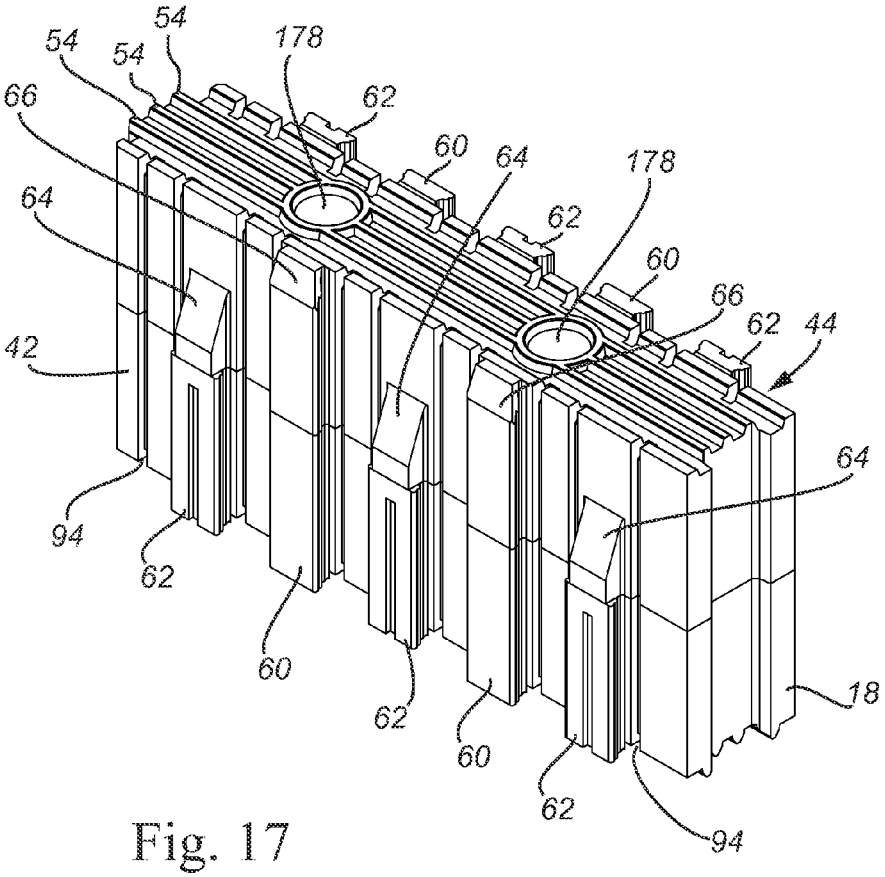
FIG. 17 is a perspective view of the exemplary insulation insert shown in FIG. 14.
Figure 18:
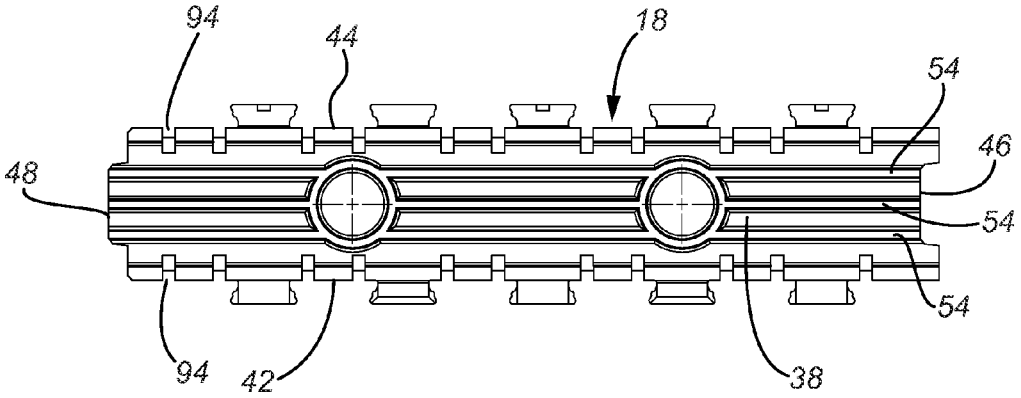
FIG. 18 is a top view.

As is particularly well shown in FIGS. 14 and 15, each of structural stretcher block 14 and face block 16 have a vertical face penetrated by vertical slots or grooves. Block 14 face 22 includes two "dovetail" cross-section, through slots or grooves 26 and three dovetail cross-section stopped slots or grooves 24.

Face block 16 face 28 includes two dovetail cross section through slots or grooves 30 on face 28 and three dovetail cross-section stopped slots or grooves 32.

Through slots or grooves 26 on block 14 penetrate both the top 34 and bottom 36 of block 14. Through slots or grooves 30 on facing 16 penetrate both of the top 38 and bottom 40 of facing block 16.

Stopped slots or grooves 30 on face blocks 16 open down (penetrating the bottom 40 of facing block 16), and stopped slots or grooves 24 on block 14 open up (penetrating the top 34 of block 14).

Insulation block 18 may be a single piece of plastic foam or other appropriate material and could also be built up from components among other alternatives. As depicted in the drawings, block 18 is a generally rectangular slab with faces 42 and 44 configured to mate with blocks 14 and 16. Portions of each block 18 may lap a portion of each block 18 beside which it is positioned end to end in order to limit transmission of heat through the wall front to back or back to front. For instance, among other alternatives such as half-lap joint, a tongue 48 on one end of each block 18 may be received in a groove 46 on the other end. Ridges 54 on the top 50 and bottom 52 compress gaskets 58 to limit heat transmission above and below insulation blocks 18.

As is apparent in several of the figures, the tongue 48 and groove 46 ends inter-fit to provide continuous insulation horizontally.

Numerous alternative insulation block end structures are possible, including among others, ship-lapping, multiple tongues and grooves, scarfing and butting.

Gasket strips 58 are captured between opposed tops 50 and bottoms 52 of insulation blocks 18 (and, more specifically between ridges 54 on the tops 50 and bottoms 52 of the insulation blocks 18), thereby providing continuous insulation vertically in the system 10. The exemplary insulation blocks 18 shown in the figures have round regions 178 (marked in FIG. 17) that result from the injection of foam during production of blocks 18 in one production method. Ridges 54 entirely encircle these regions 178 to insure a good and continuous seal between the top 50 of insulation blocks 18 and overlying gasket 58. Such round regions are not necessary to the practice of this invention. Gasket 58 is seated between insulation blocks 18 to provide a continuous thermal barrier up and down the wall 10 of this invention. Additionally, it transmits water vertically and helps prevent mortar from blocking the ends of water management grooves 94 in the faces of insulation blocks 18. Gasket 58 can be made in a number of different configurations and lengths, and usable gasket could be made with differences in each of the structural characteristic depicted in the Figures and described here.

Figure 38:
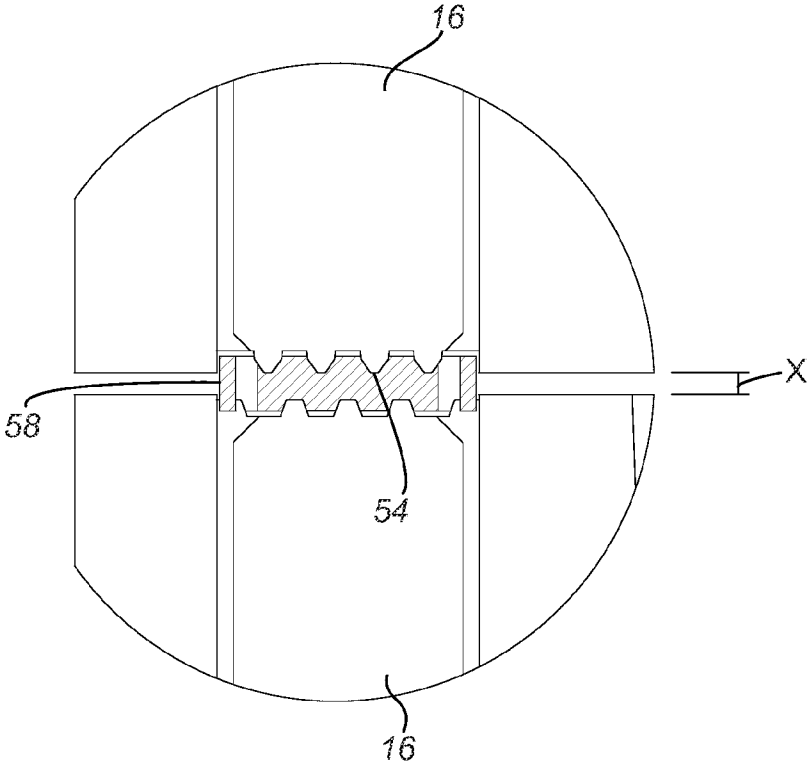
FIGS. 37 and 38 are end views of like stacked block sub-assemblies of this invention and gasket material with the thickness of grout in FIG. 37 about twice that in FIG. 38.
Figure 37:
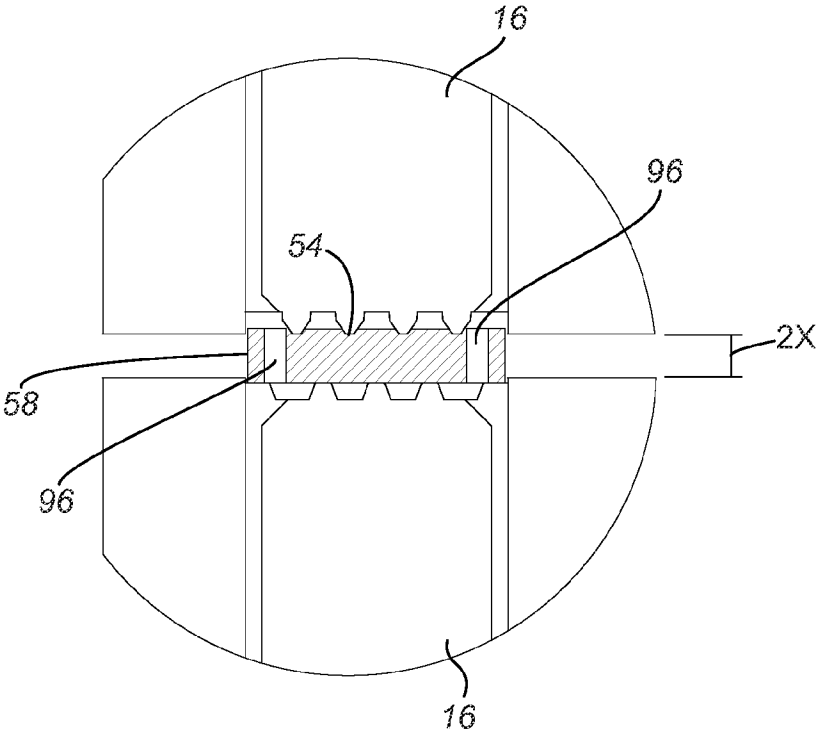

Gasket 58 may be made of any appropriate material. Compliant material that can compress to adjust for differences in the thickness of mortar between blocks, which mortar establishes the spacing between blocks, is desirable so that a good seal will be achieved notwithstanding such variations in mortar thickness and block spacing. FIGS. 37 and 38 depict gasket 58 between upper and lower insulation blocks 18 with different spacing and differing amounts of compression of gasket 58. Such gasket material may, for instance, accommodate mortar joints including and between approximately ¼ inch and ½ inch in thickness.

Appropriate gasket materials will typically be somewhat flexible, preferably provides good insulation slowing transmission of heat and should be a resilient material that can be somewhat compressed between insulation blocks 18 to provide a seal between such blocks while resisting passage horizontally of air, water or heat. Usable materials may include expanded styrene, polystyrene, polypropylene and other foams, neoprene, natural and synthetic rubbers and other polymer materials and other suitable conventional and newly-developed gasket materials. Adhesive may be pre-applied to one or both of the top and bottom gasket surfaces, and such adhesive may be protected with a release paper or film that is removed before installation.

The faces 42 and 44 of each insulation block 18 are the same but are rotated 180 degrees (or flipped) about a horizontal axis relative to each other. Each face 42 and 44 includes two vertically oriented dovetail "tails" or keys 60 essentially the full height of block 18 and three dovetail tails or keys 62 that are not full height. Keys 62 are topped by a sloping ramp surface 64 that dies into the face 42 or 44 of the block 18 as the case may be, and each of tails or keys 60 terminates in a shorter ramp 66 that does not extend all the way to face 42 or 44 as the case may be. Grooves 24 in block 14 and grooves 32 in face block 16 terminate in sloping regions or ramps 68 in the case of grooves 24, and ramps 70 in the case of grooves 32.

Figure 25:
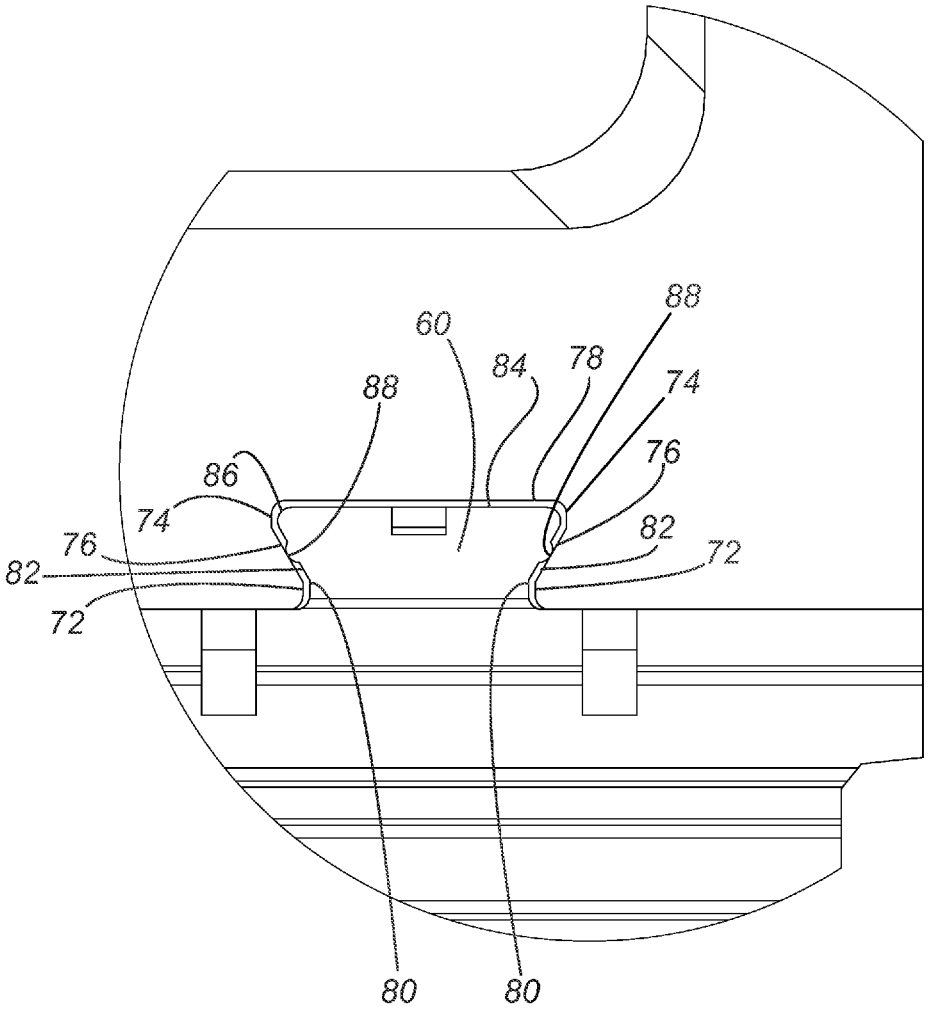
FIG. 25 is an enlarged fragmentary top view of the relative geometry of an exemplary sliding dovetail joint between the insulation and structural block of this invention.

As may be appreciated by reference to FIG. 25, the cross sectional shape of each groove may actually be more complex than the simple "dovetail" shapes used, for instance, in woodworking, where the "dovetail" shape is usually defined by only three planes, two of which are sloping relative to the face of the workpiece and the third of which is parallel to the face of the workpiece. The exemplary cross sectional shape of the slots or grooves of the embodiment of this invention depicted in the drawings may be defined by: (a) parallel entry walls 72 that face each other, (b) inner walls 74 that are likewise parallel and facing each other, (c) sloping walls 76 that join walls 72 and 74, and a back wall 78 that joins the two inner walls 74. This structure avoids inclusion of any "inside" or "outside" acute corners (i.e., corners less than 90°), which facilitates manufacture and the avoidance of damage because such acute corners are easily broken (in the case of outside corners) or jammed with debris (in the case of inside corners).

As can also be seen on FIG. 25, the tail or key 60 is generally defined by parallel neck walls 80, sloping walls 82 and exterior wall 84, with the corner 86 formed by walls 82 and 84 rounded over. Significantly, a small vertical raised area or rub rib 88 on each sloping wall 82 provides an easier slip fit (by reducing the total contact area between grooves and tails), with firm sealing contact (between the groove walls 76 and the rub rib 88), and accommodates manufacturing mold wear resulting in changes in component dimensions.

Figure 20:
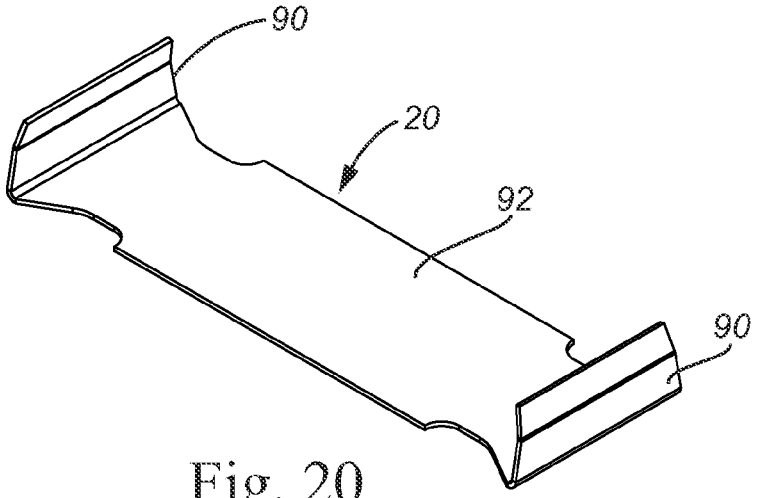
FIG. 20 is a perspective view of the exemplary anchor shown in FIG. 14.
Figure 19:
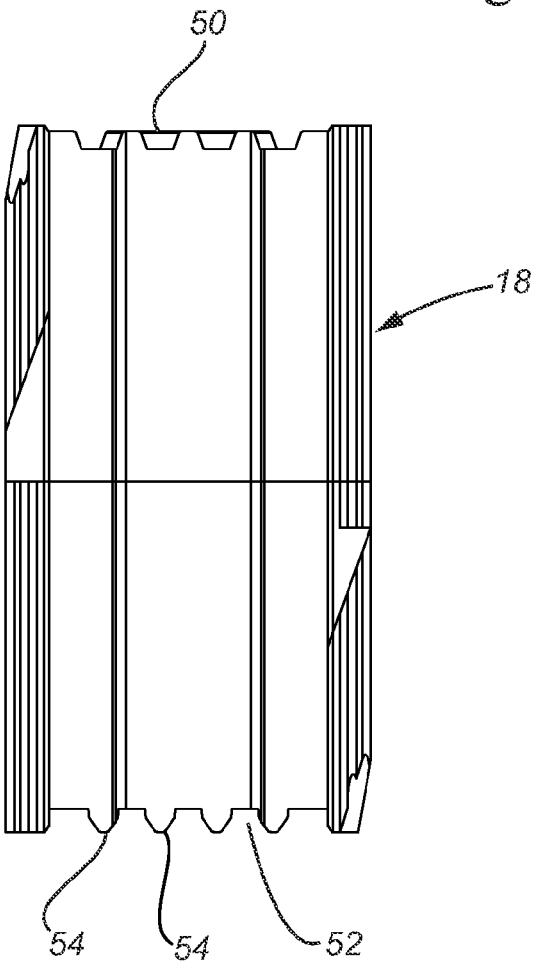
FIG. 19 is an end view, of the insulation insert of FIG. 17.
Figure 22:
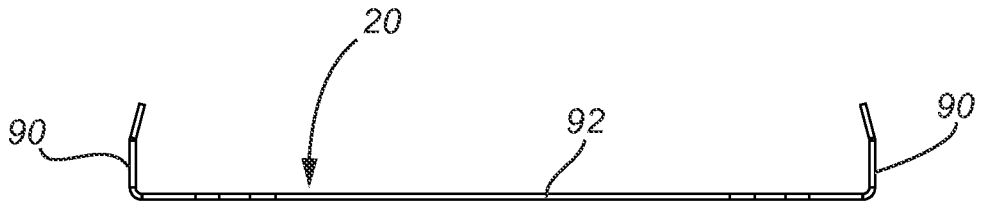
FIGS. 21 and 22 are top and side views, respectively, of the exemplary anchor of FIGS. 14 and 20.
Figure 21:
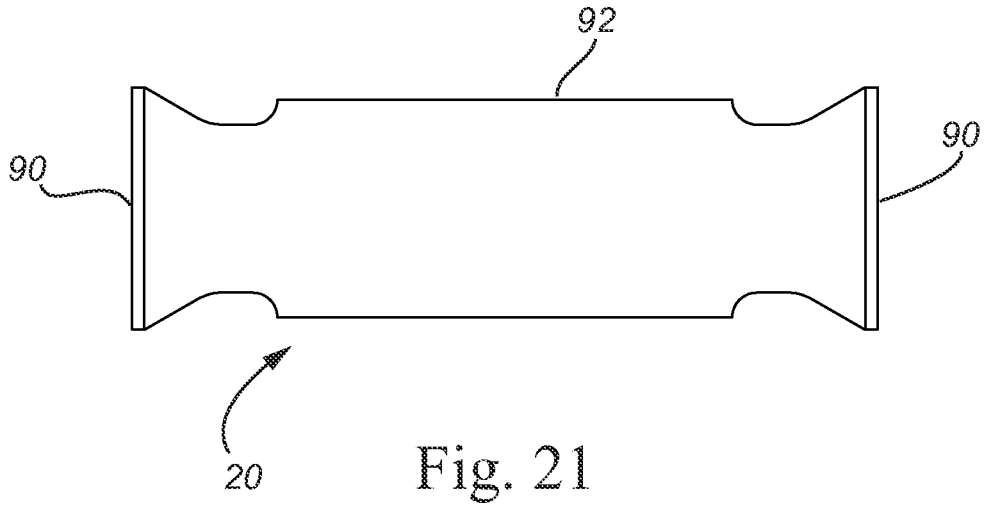

As can be appreciated by reference to FIGS. 20-24, anchors 20 are imbedded in insulation blocks 18 to prevent separation of facing 16 from structural blocks 14. Such anchors 20 may insure the integrity of the wall in the event of fire, wind loading or earthquakes. As shown in FIGS. 20, 21 and 22, anchors 20 may be fabricated of sheet metal to provide two dovetail-shaped opposite ends 90 integrally formed with a neck or plate 92 between them.

Anchors 20 are dimensioned so that they can be positioned within insulation block 18 entirely encapsulated by the material of the insulation block 18, and with the dovetail-shaped ends 90 positioned within opposed grooves 24 and 32 of face block 16 and structural block 14, respectively, when insulation blocks 18 are assembled with structural blocks 14 and face blocks 16. If the insulating material of insulation block 18 burns, melts or otherwise loses its integrity, because, for instance, the structure 10 is loaded beyond the ability of insulation blocks 18 to secure face block 16 to stretcher block 14, anchors 20 will prevent face blocks 16 from falling away from structural blocks 14 because the ends 90 are wider than the mouths of grooves 24 and 32. As a result, vertical downward movement of face block 16 will drive the end 90 of anchors 20 up against ramp 70 in facing block 16 and down against ramp 68 in block 14. This will typically prevent the face block 16 from falling off or otherwise away from the structure provided by blocks 14.

Because anchor 20 is entirely encapsulated by the insulation material of block 18 (absent fire or other degradation of insulation 18), anchor 20 does not contact either of block 14 or face block 16 and thus does not provide a thermal bridge between face block 16 and structural block 14.

As depicted in the Figures illustrating an exemplary system of this invention, anchor 20 may be fabricated of sheet metal of any suitable type, including steel, stainless steel, aluminum and other metals and alloys. Many other materials and cross sectional and longitudinal shapes are possible. For instance, among other possibilities, anchor 20 could be forged, molded or cast of metal or another material (including, without limitation, polymers and polymer composites) with appropriate thermal and structural properties so that the anchor 20 will not melt or burn at the temperatures encountered in structure fires and have sufficient strength and an appropriate shape to keep the face block 16 coupled to the structural blocks 14 in the event of a fire or other circumstance that damages the material of insulation block 18.

Anchor 20 also may be made of wire, bar or rod bent or otherwise formed into a suitable shape. Selection of material and configuration of anchor 20 will be typically dictated by the size and composition of the other system components and the temperature (in a fire) and other extreme physical conditions it is desired that anchor 20 be able to withstand. For instance, stainless steel anchors 20 may be desirable in particularly corrosive environments.

This masonry system may provide highly effective management of water. As an example, the components depicted in the figures provide drainage of water away from the interior of structural stretcher blocks 14 and, therefore, away from the interior of a building wall or other structure made of the components of this invention.

First, full length grooves 26 in stretcher block 14 and grooves 30 in face blocks 16 permit any water within those grooves to drain down while remaining near the exterior of a structure made from these components. Water that enters grooves 24 in block 14 drains down and then away from the interior of block 14 when it encounters ramps 68. The vertical spaces between the interlocking components illustrated in FIG. 25 accommodate such vertical drainage.

Second, vertical water management grooves 94 are incorporated in both the front and rear faces 42 and 44, respectively, of insulation blocks 18 to permit water to flow down either the front or back of blocks 18.

Figure 31:
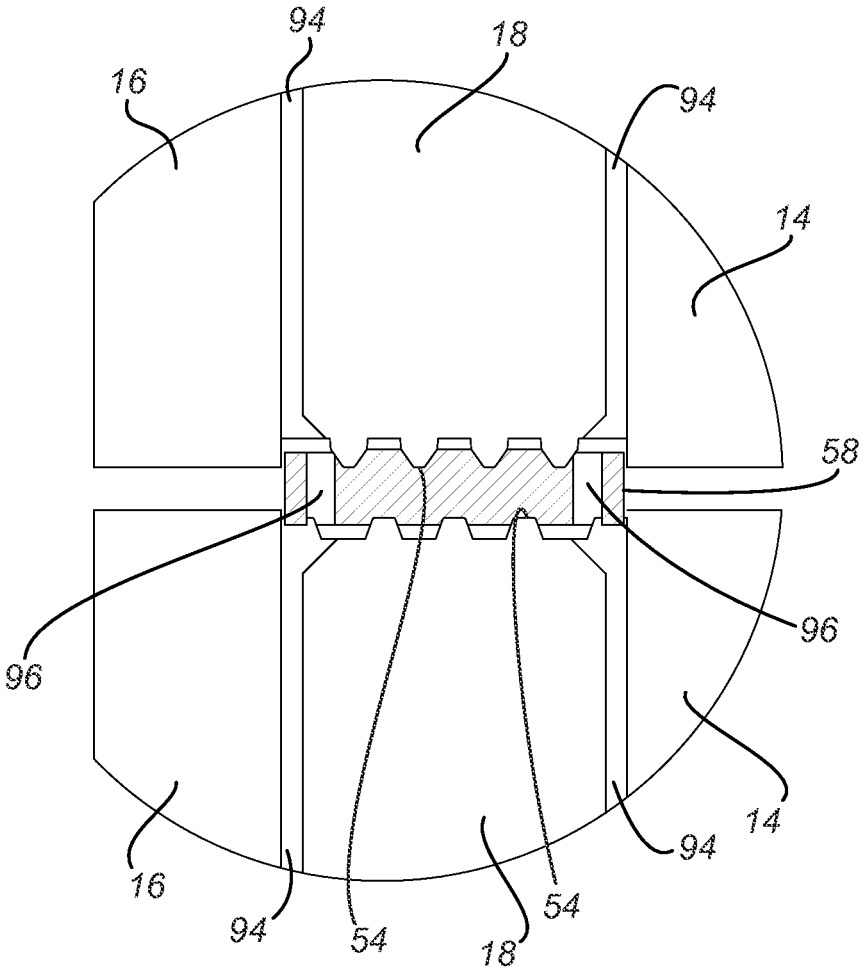
FIG. 31 is an enlarged end view of exemplary gasket material between two insulation blocks of this invention.

Third, gasket 58 (FIGS. 1 and 31, among others) that is positioned horizontally between insulation blocks 18 is perforated by vertical holes 96 through which water can drain from grooves 94 in an insulation block 18 above the gasket 58 and into grooves 94 in an insulation block below that gasket 58. Including relatively closely spaced vertical holes 96 in gasket 58 will insure that at least one such vertical hole 96 will be near each vertical groove 94 in insulation 18.

Figure 26:
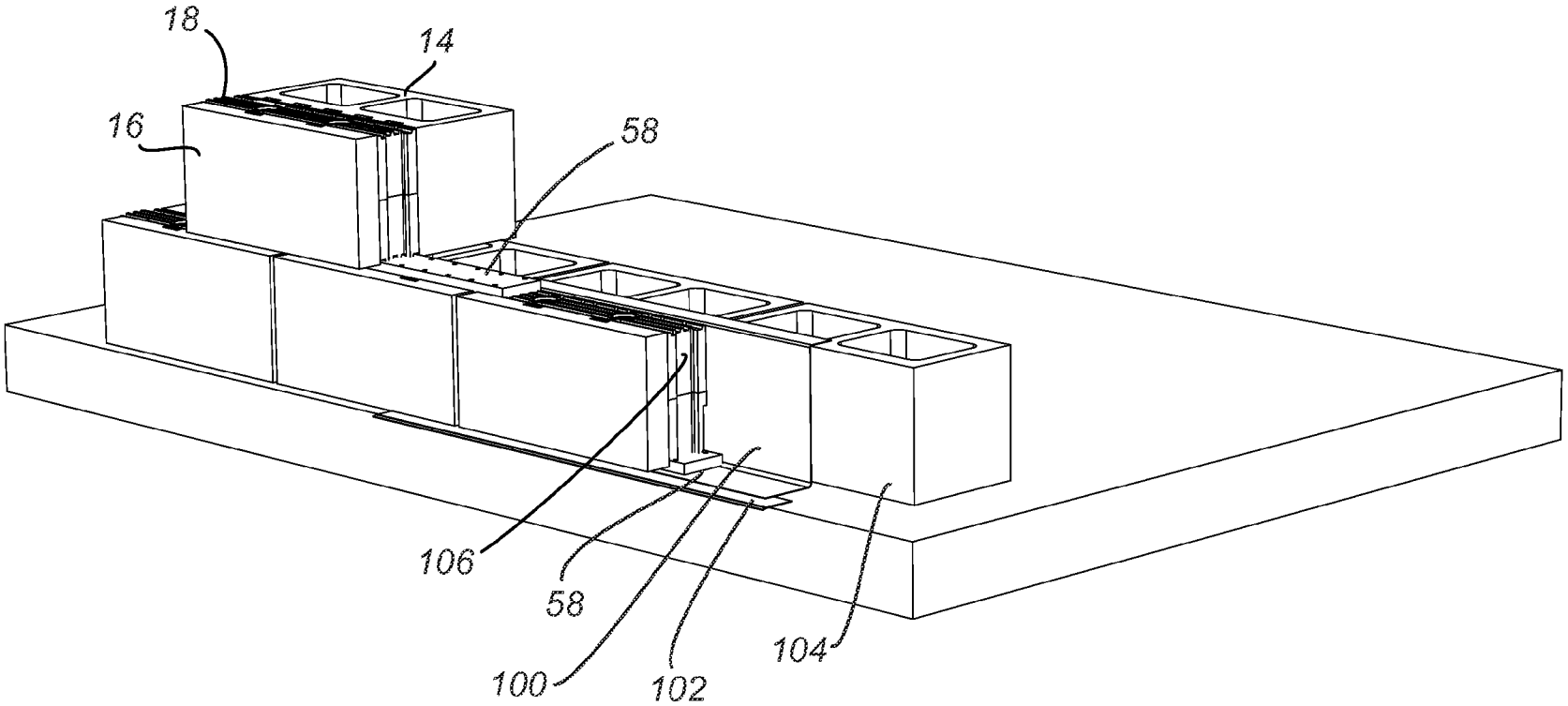
FIG. 26 is an end perspective view of a first course or bottom row of an exemplary embodiment of a wall of this invention.
Figure 27:
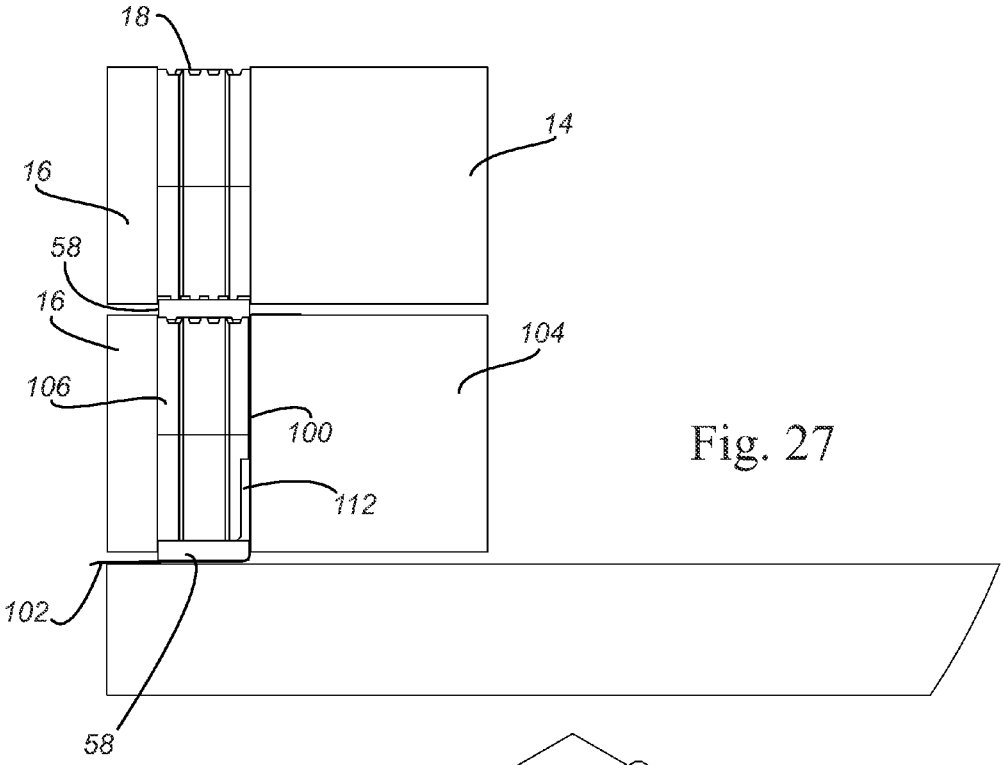
FIG. 27 is a side view of the exemplary installation of FIG. 26.

Fourth (and finally), an appropriate water path may be provided out the front of the wall at a foundation, at a lintel, or at another location where the downward extending wall stops. Such a "bottom row" detail at a floor or foundation is depicted in FIGS. 26 and 27. A metal, membrane or other flashing 100 is provided so that there is a path to the outside extending from a location above and behind the lowest course of structural blocks down and under the lowest course of insulation blocks 18 and facing blocks 16. Because this configuration prevents any connection between the lowest (first course) insulation blocks 18 and the structural blocks, common concrete blocks 104 may be used for the first course, and the tails or keys 60 and 62 are removed (for example, by wire cutting) from the rear-facing side 44 of block 18 to result, for example, in a modified insulation block 106 depicted in FIG. 28. Cotton cords or other appropriate water conduits may be positioned on top of blocks 104, over the flashing 100 and out to the front of facing 16.

Figure 28:
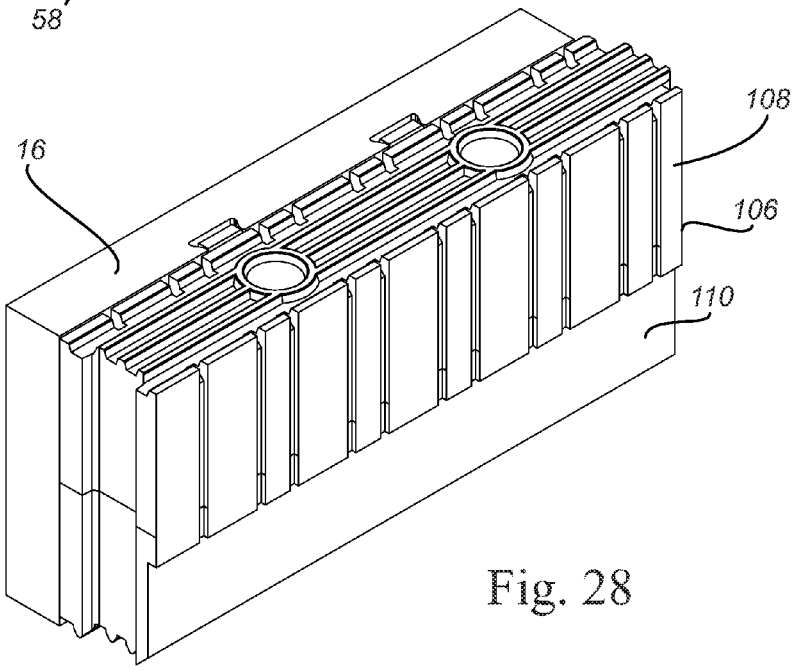
FIG. 28 is a perspective view of a face block and a modified insulation block used in a first course or lintel installation such as those depicted in FIGS. 26, 27, 29 and 30.
Figure 29:
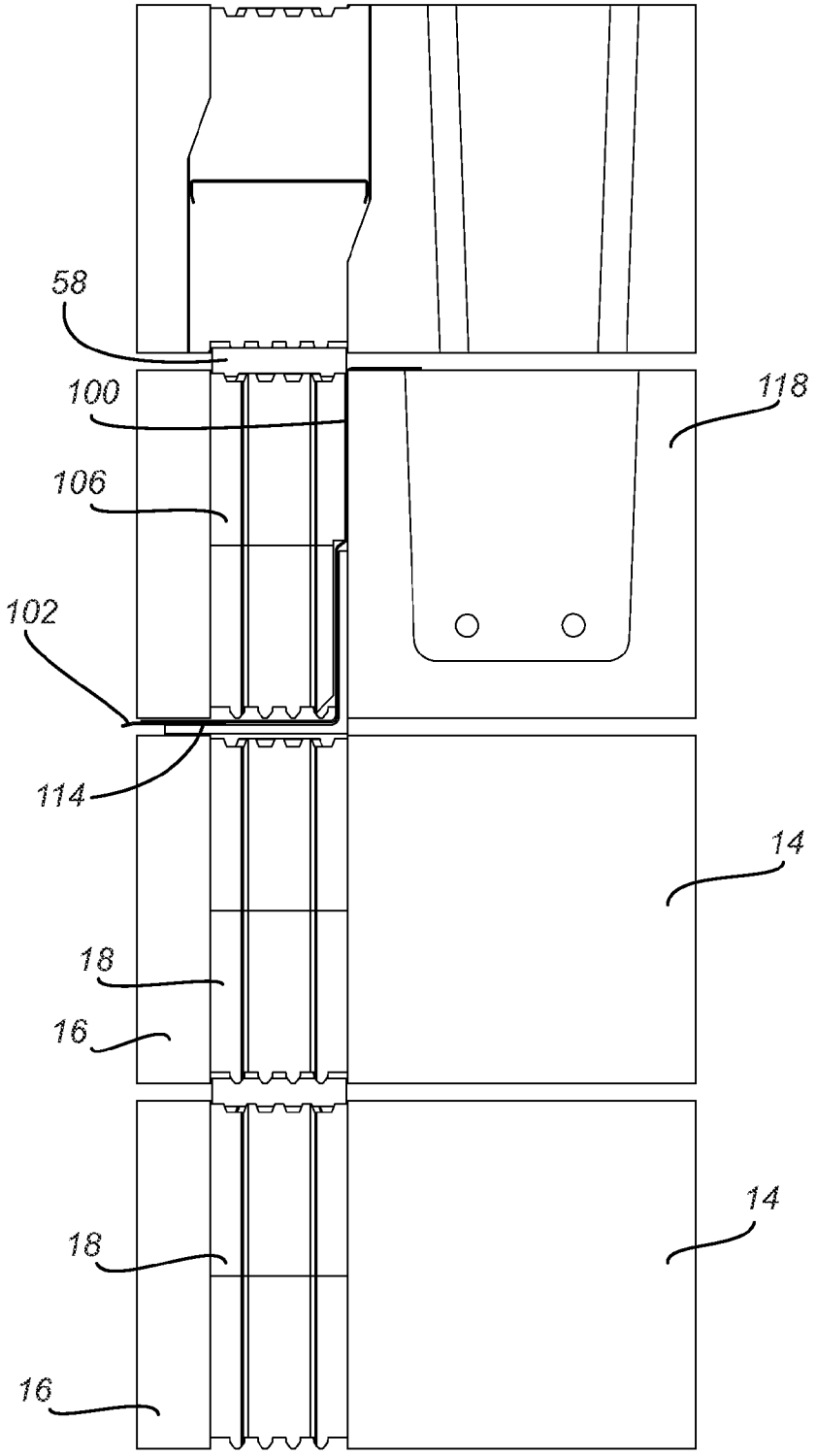
FIG. 29 is an end view of an exemplary embodiment of a lintel installation of this invention.
Figure 30:
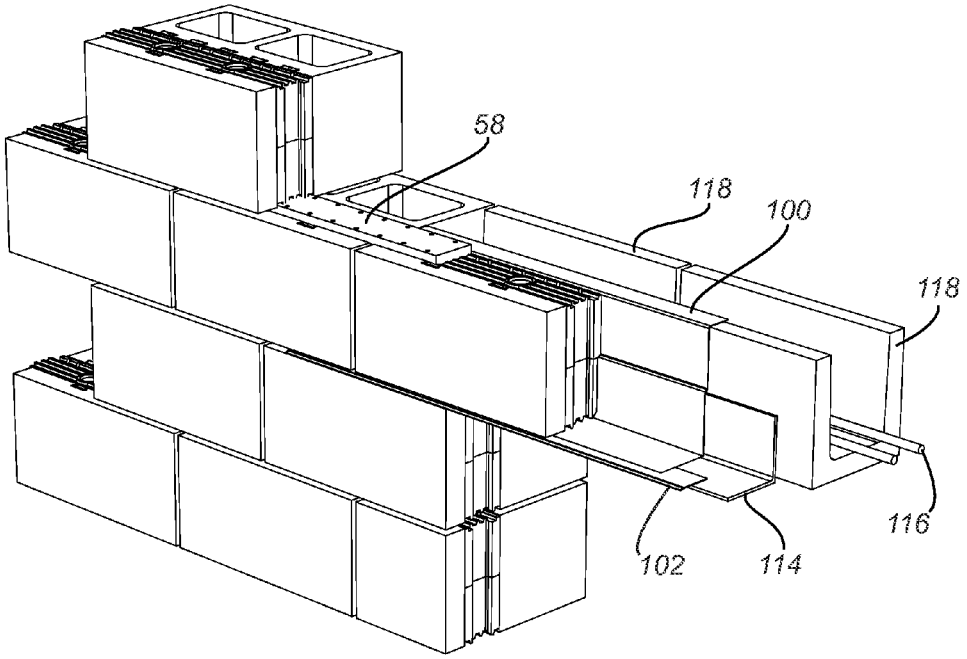
FIG. 30 is a perspective view of the exemplary lintel installation of FIG. 29.

Insulation block 106 shown in FIG. 28 may be produced by omitting the anchors 20 and cutting off just the tails or keys 60 and 62 in an upper portion of the block, so that water management grooves 94 are intact, ensuring channels for water to travel down between the upper portion 108 of block 106. If desired, water management grooves 94 may be enlarged. Adhesive may be positioned on the block 106 to bond to the flashing. More of block 106 may be removed in a lower portion 110 of block 106. This defines a vertical slot or pocket 112 between the lower portion 110 of block 106 and flashing 100 (well depicted in FIG. 27). Such a pocket or slot 112 helps to accommodate a lintel angle 114 used at a header location, as depicted in FIGS. 29 and 30, which show use of such a lintel angle 114 together with rebar 116 and bond beam concrete masonry units 118. Although not depicted in FIG. 29 to avoid confusion, gasket 58 may be positioned on top of flashing 100 and lintel angle 114 and under the insulation block 106.

Insulation blocks 18 may be formed of expanded polystyrene or other expanded, foamed, fused, bonded or other polymer materials or a wide variety of other suitable materials providing the structural and thermal blocking properties appropriate for this member and any other desirable properties that may include strength, flame retardation, smoke suppression and water impermeability.

The insulation block 18 may be made of conventional expandable polystyrene foam and of modified polystyrene foam such as BASF Neopor® foams, which are expandable polystyrene foams formulated with graphite in the cell structure, creating a grey-hued material that, according to the manufacturer, provides better thermal performance than traditional expandable polystyrene foam. Other foams and other insulating materials may also be used, such as polyurethane or isoprene foams, among others. The insulation blocks 18 may be formed in suitably shaped molds that may include magnetic or other clips or hold-downs that hold the anchors in place within the mold while the expandable foam is introduced into the mold cavity and the insulation block 18 is formed. Essentially any front to back thickness of insulation block 18 is usable that is thick enough (i.e., on the order of at least about 1" thick) to form the desired structure and provide heat insulation. Thicknesses between approximately 1" and approximately 10" will typically be appropriate, but thinner and thicker insulation blocks 18 are also possible. The thickness of the insulation block 18 can be adjusted to achieve a desired R value for a particular foam material or to match desired dimensions of the structure within which the block system of this invention is to be used.

Figure 23:
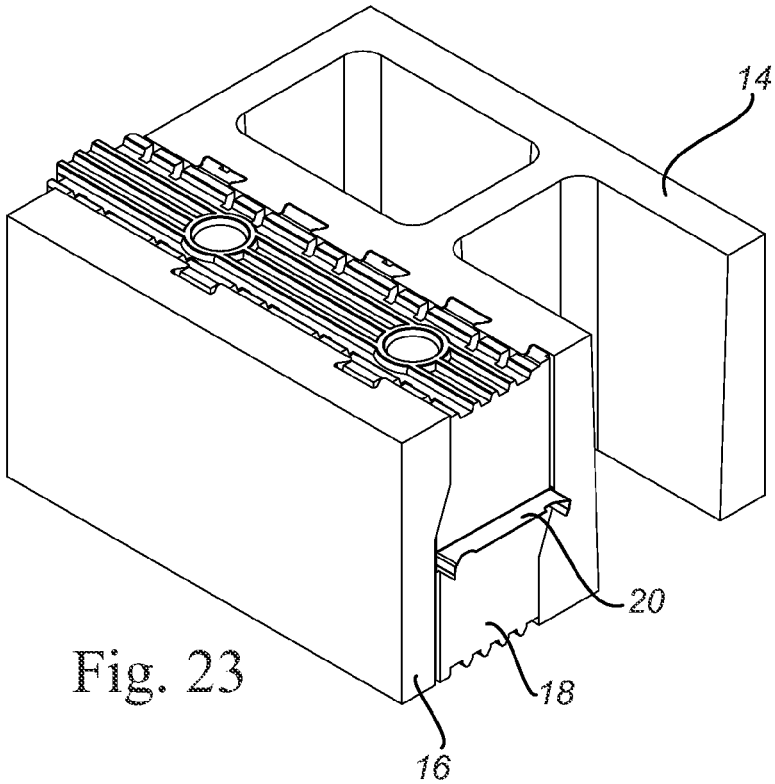
FIG. 23 is a perspective view of the exemplary stretcher unit shown in FIG. 2 with a vertical section exposing one of the anchors.
Figure 24:
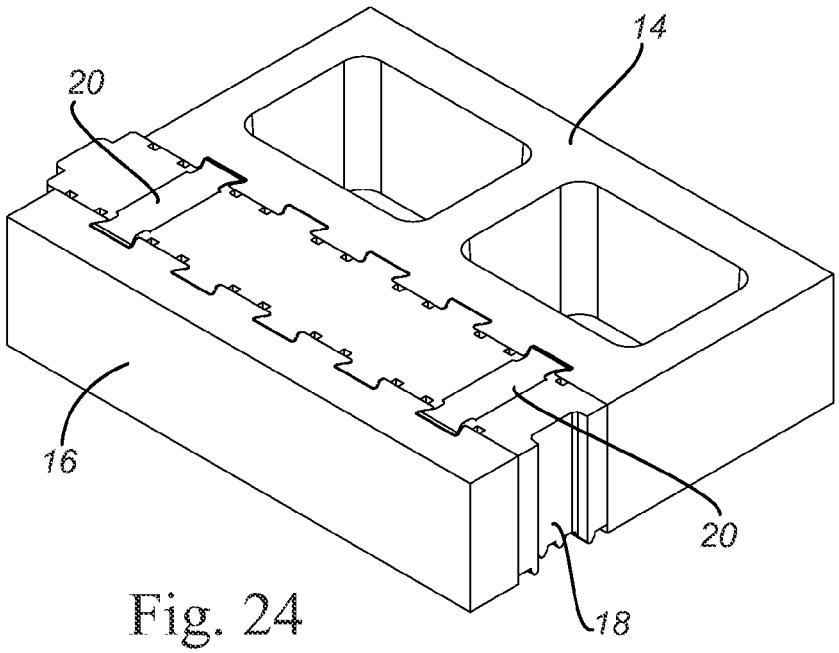
FIG. 24 is another perspective view of the exemplary stretcher unit shown in FIG. 2 with a horizontal section taken just above the anchors or anchors to show their positions in the assembly.

As is indicated in FIGS. 14, 23 and 24, anchors 20 are positioned within the mold so that one will be located with one of its ends in each of the opposing stopped keys 62 located near the ends of the insulation block 18 and approximately centered top to bottom within the insulation block 18. Thus, in the examples depicted in the drawings, two anchors 20 attach each facing block 16 to each structural block 14, and there is no anchor 20 in the centrally located stopped keys 62.

Other numbers of grooves and tails or keys in blocks 14, 16 and 18 may be used than the number depicted in the drawings and described above, and different numbers of anchors 20 can be utilized than the number depicted in the drawings and described above.

Although not depicted in the drawings or described above, a single facing block 16 may overlap and adhere or otherwise attach to a plurality of insulation blocks 18 containing one or more anchors 20, and a single insulation block 18 containing one or more anchors 20 may overlap and adhere or otherwise attach to a plurality of structural blocks 14. Thus, a single facing block 16 may overlap with a plurality of structural blocks 14, and a single insulation block 18 containing one or more anchors 20 may overlap with a plurality of facing blocks 16, structural blocks 14, or both.

One of the advantages of the block system of this invention is that there are three mortar locations within the thickness of a wall rather than the two typical in a conventional concrete block wall. Specifically (with reference to FIG. 2), there are mortar locations (1) along the front top 120 and adjacent ends of block 14, (2) along the rear top 122 and adjacent ends of block 14 (as in a typical concrete block wall), and (3) there are also mortar locations along the top, bottom and end of facing block 16. This additional mortar line between facing blocks 16 provides additional sealing and integrity in the walls and other structures of this system.

Figure 32:
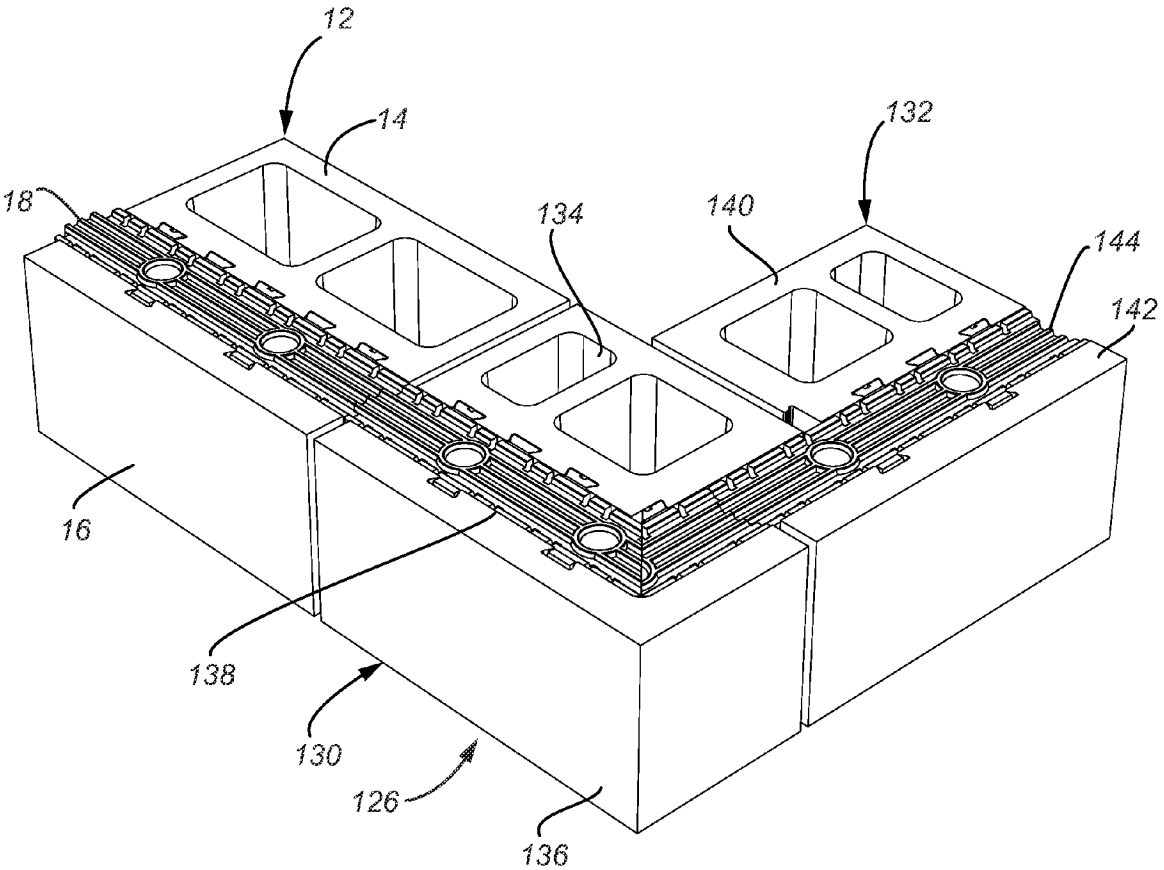
FIGS. 32 and 33 are right hand and left hand corner assemblies, respectively, of this invention.
Figure 33:
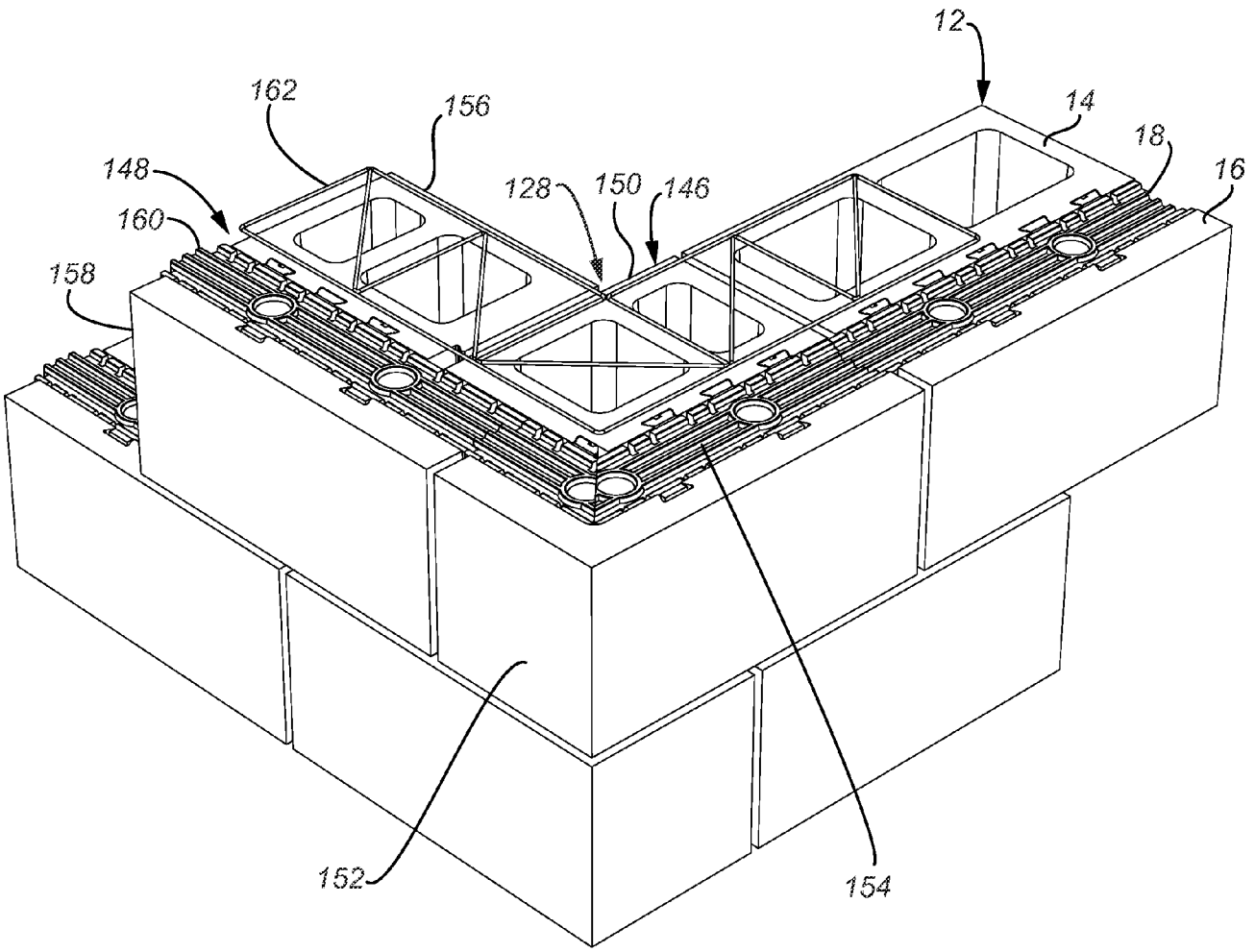

FIGS. 32 and 33 depict construction of successive courses of a wall of this invention at a corner, illustrating an approach for achieving a strong, attractive corner incorporating the insulation and other benefits of this disclosure.

Numerous other components consistent with this invention may be used in order to form corners. The approach illustrated here is but one example.

In this example, FIG. 32 depicts a standard or stretcher unit 12 incorporating a stretcher block 14, a facing block 16 and an insulation block 18 together with a "right hand corner" assembly 126. Similarly, FIG. 33 depicts a second course including a standard or stretcher unit 12 incorporating a stretcher block 14, a facing block 16 and an insulation block 18 together with a "left hand corner" assembly 128.

Figure 6:
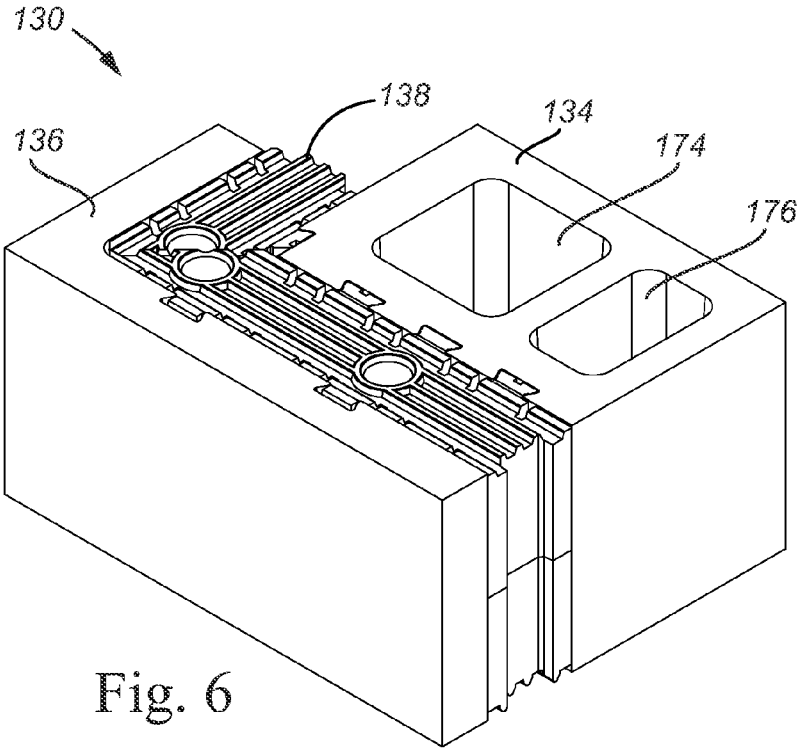
FIGS. 6 and 7 are perspective views of exemplary left corner sub-assemblies of this invention.
Figure 7:
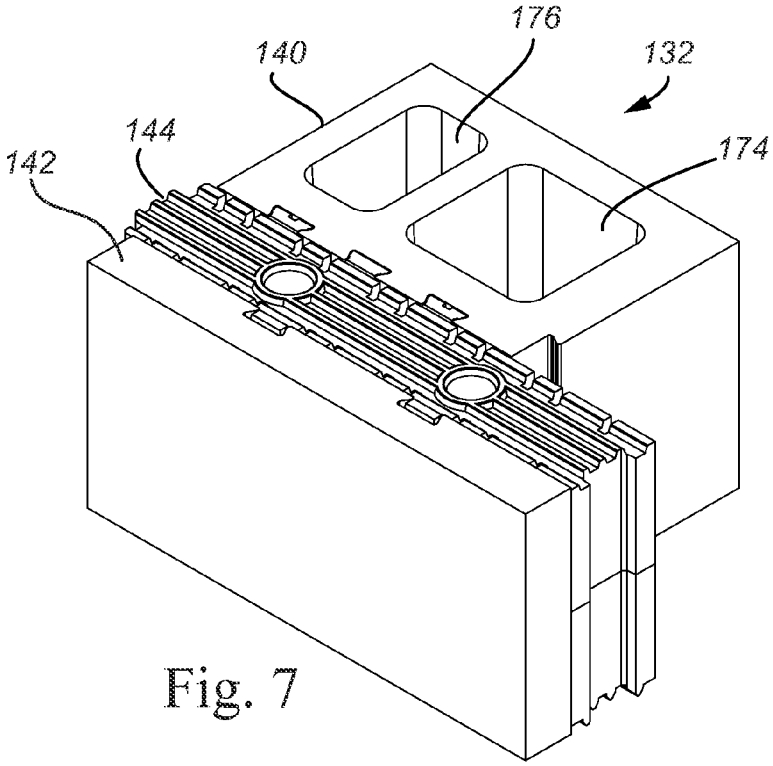
Figure 8:
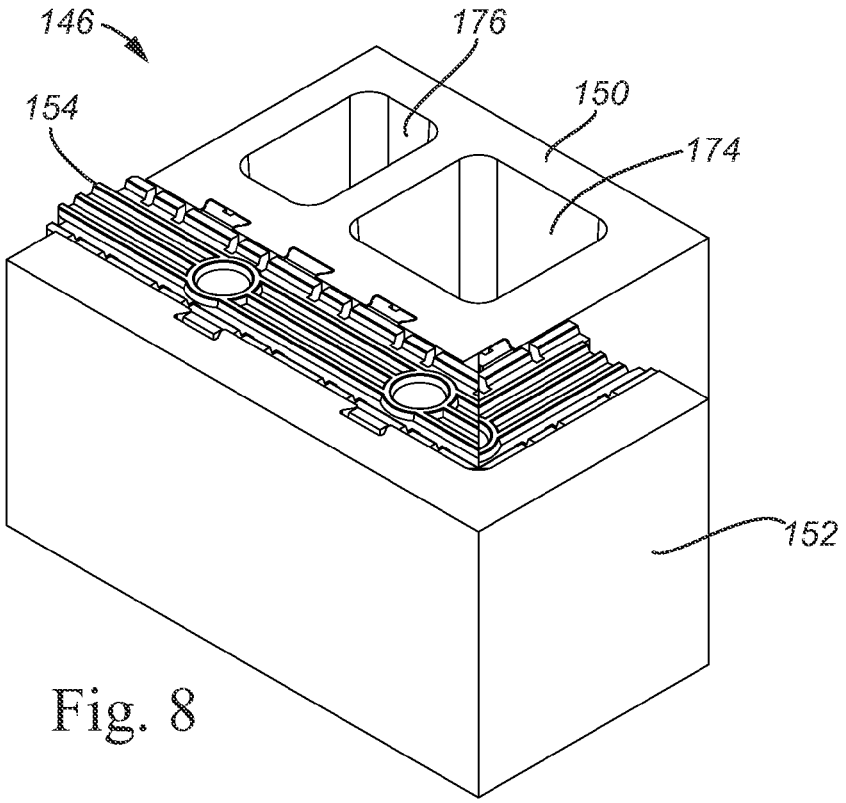
FIGS. 8 and 9 are perspective views of exemplary right corner sub-assemblies of this invention.
Figure 9:
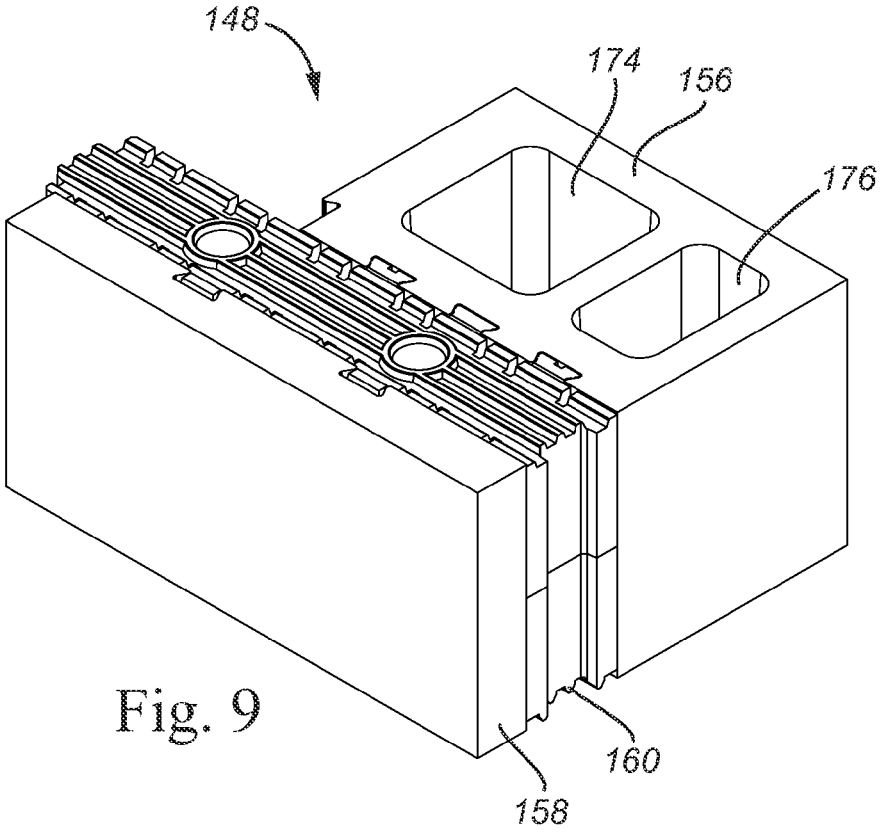
Figure 10:
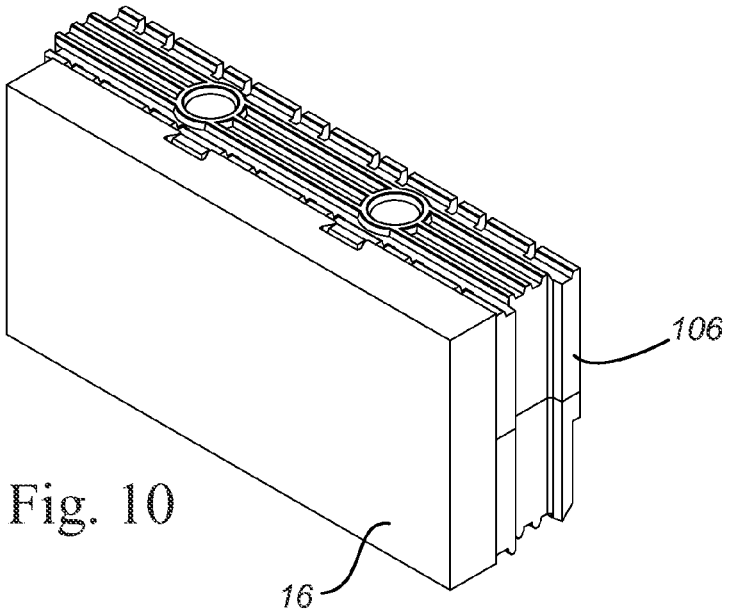
FIG. 10 is a perspective view of an exemplary facing sub-assembly of this invention usable for first course and lintel structures.

Right hand corner assembly 126 depicted in FIG. 32 may include right L-corner sub-assembly 146 shown in FIG. 8 and a right lapping corner sub-assembly 148 shown in FIG. 9. Left hand corner assembly 128 depicted in FIG. 33 may include left L-corner sub-assembly 130 shown in FIG. 6 and a left lapping corner sub-assembly 132 shown in FIG. 7. These assemblies can be used at structure corners and returns. Each sub-assembly in FIGS. 7 and 9 has a structural block, a facing block and an insulating block, as set forth in this table:

TABLE 1

| | Sub-assembly element | | |
|---|---|---|---|
| Sub-assembly | Structural block | Facing block | Insulation block |
| Left L-corner 130 | 134 | 136 | 138 |
| Left lapping corner 132 | 140 | 142 | 144 |
| Right L-corner 146 | 150 | 152 | 154 |
| Right lapping corner 148 | 156 | 158 | 160 |

As is apparent in the figures, the four sub-assemblies 130, 132, 146 and 148 may be made using only two special structural blocks. More specifically, blocks 134 and 156 may be identical, and blocks 140 and 150 may be identical.

Special purpose blocks and sub-assemblies in accordance with this disclosure can incorporate a wide variety of interlocking and anchoring configurations. In the exemplary configurations shown in the figures where blocks 134 and 156 are the same and blocks 132 and 150 are the same and the blocks have a "standard" size cavity 174 and a smaller cavity 176 (marked in FIGS. 6 and 7). Additionally, each of the blocks may have a dovetail groove in one end near the standard size cavity 174 and adjacent to one block longer face, together with three such grooves on the adjacent longer face. The other blocks are the mirror image. Among other things, this configuration permits structure corners to be built with corner blocks 134/156 and 132/150 having vertically aligned standard size cavities in the corner of the structure. Rebar and grout or concrete can be placed in those vertically aligned cavities to strengthen the structure. This configuration also accommodates the insulation block 18 structure depicted in the figures and described above. A full length block 18 with the appropriate two of its dovetail keys removed (making insulation blocks 144 and 160) is used with structural blocks 156 and 140. An L-shaped insulation block 138 or 154 is fabricated by appropriately cutting and joining (with adhesive or other means) mitered portions of insulation blocks 18. Using the positioning of anchors 20 within insulation block 18 described above and depicted in the figures, one anchor will remain in insulation blocks 144 and 160, and two anchors will remain in insulation blocks 138 and 154. Other numbers and configurations of anchors and keys in insulation blocks are possible.

Figure 34:
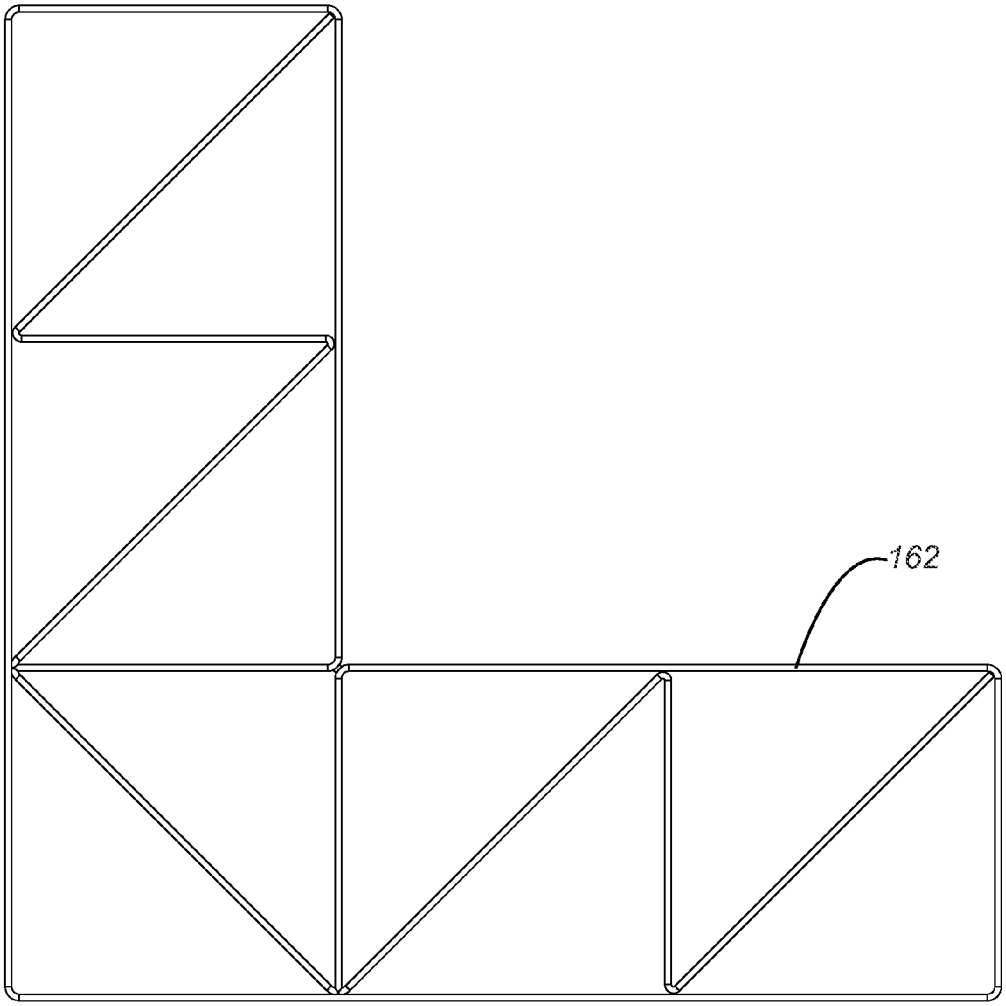
FIG. 34 is plan view of a corner reinforcement structure.

Corner reinforcement tie wire inserts 162 (see FIG. 34) may be used as shown in FIG. 33 where additional corner strength is desired. Similarly, mortar or grout can be placed in any or all of the block 14 cavities. The cavities align vertically so that, rebar can be inserted in vertically aligned block 14 cavities together with mortar to provide further strength, particularly, for instance at corners of structures of this invention.

Figure 3:
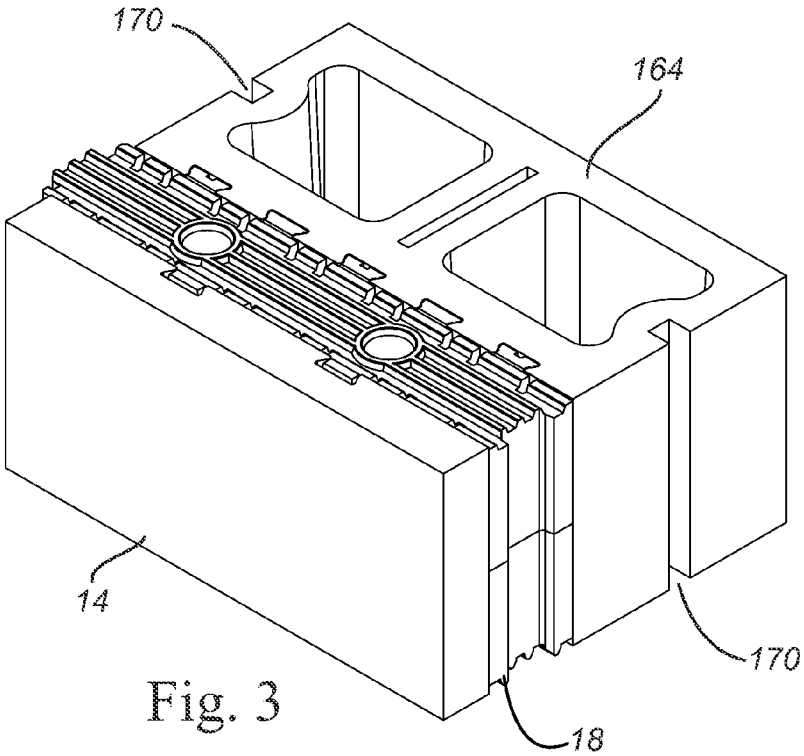
FIG. 3 is a perspective view of an exemplary sash sub-assembly of this invention.
Figure 4:
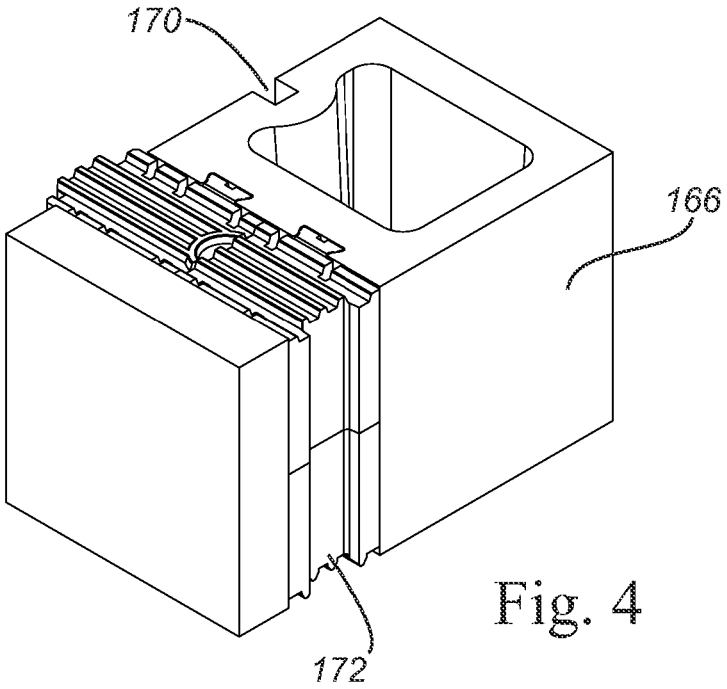
FIG. 4 is a perspective view of an exemplary right half sash sub-assembly of this invention.
Figure 5:
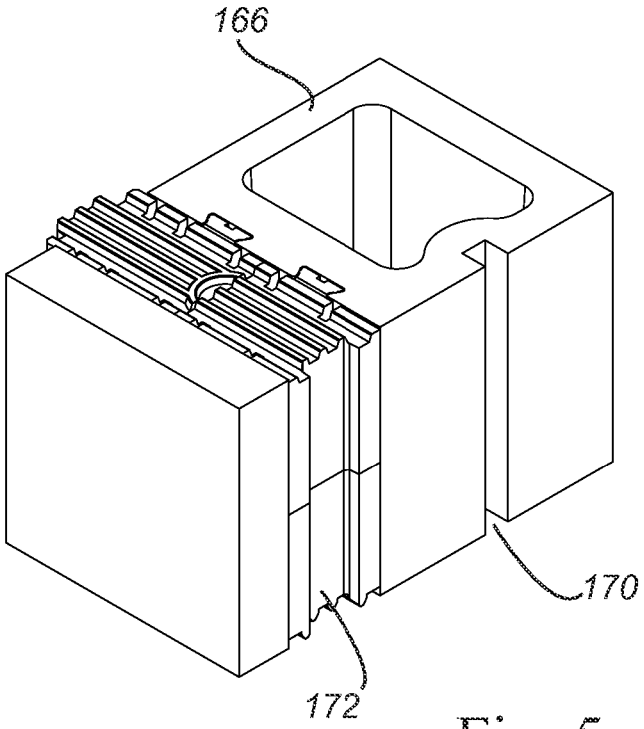
FIG. 5 is a perspective view of an exemplary left half sash sub-assembly of this invention.
Figure 35:
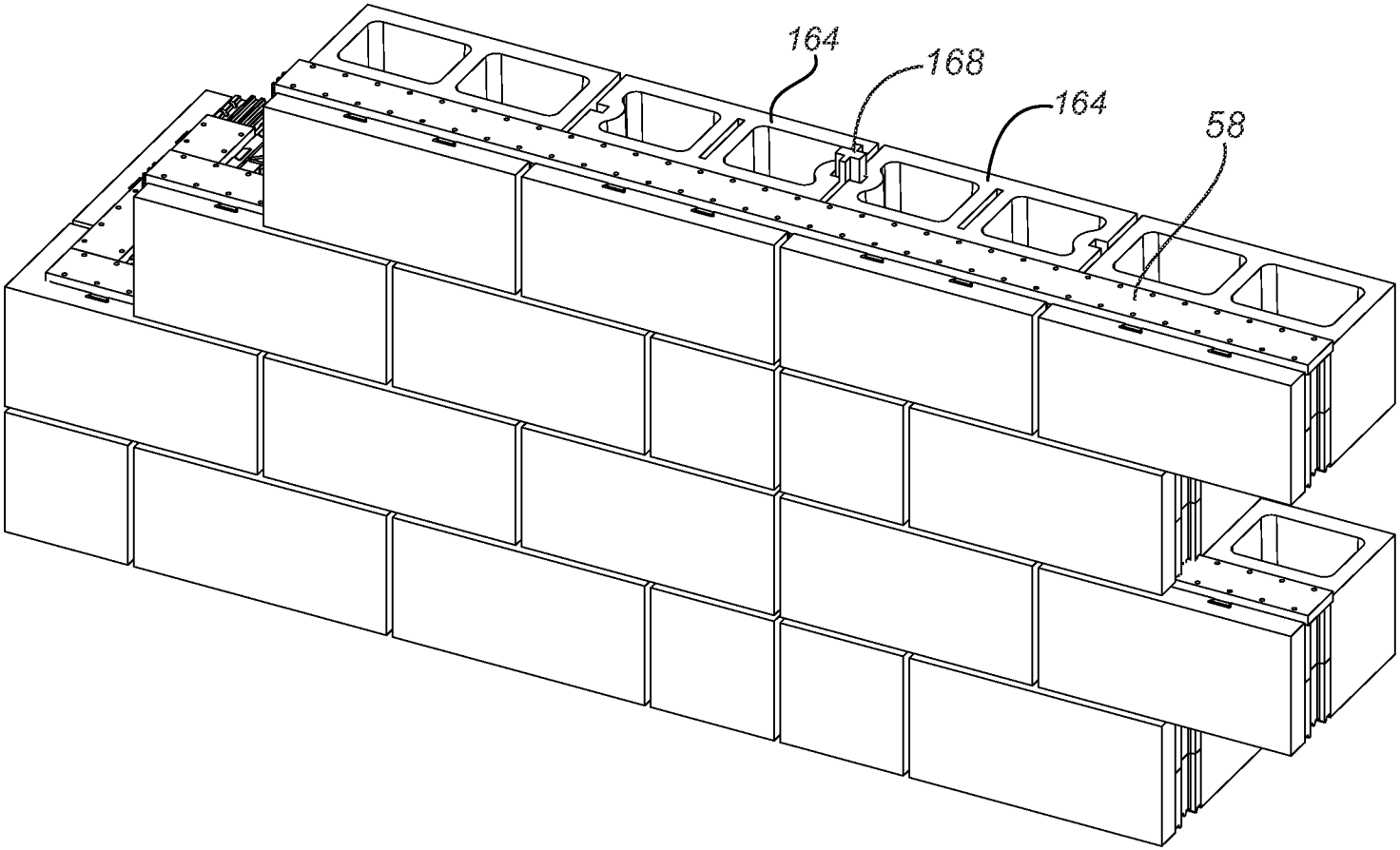
FIG. 35 is a perspective view of an exemplary wall of this invention, the top course of which utilizes full sash blocks to accommodate movement.
Figure 36:
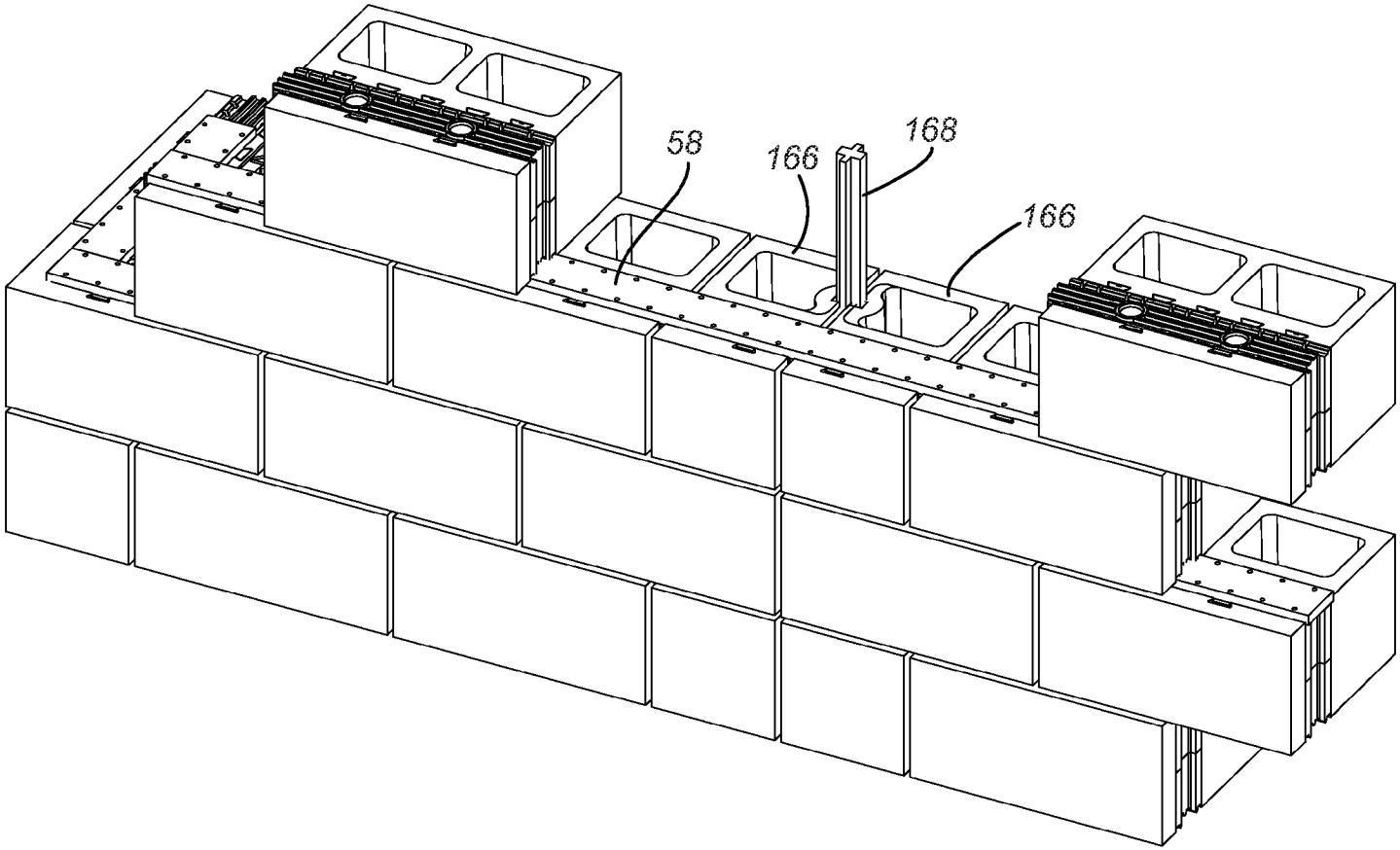
FIG. 36 is a view of an exemplary wall like that of FIG. 35 showing a movement joint using sash half blocks.

Accommodation for wall movement because of temperature changes or other factors without creation of an air or water-admitting penetration through the entire wall can be accomplished with (full size) sash blocks 164 as depicted in FIG. 35 and with half sash blocks 166 as depicted in FIG. 36, together with a gasket or barrier 168 having an X-shaped cross-section that is received in opposed grooves 170 in the sash blocks 164 or half sash blocks 166. Sash blocks 164 and half sash blocks 166 are shown individually in FIGS. 3, 4 and 5.

The exemplary structural blocks 14 and other structural blocks of this invention may be made using conventional, typically inexpensive, concrete materials or from a variety of other cementitious materials and other compositions providing sufficient strength, density and other qualities appropriate for the particular application. The blocks 14 shown in the drawings have flat top webs. Such blocks can also be produced with webs with V-shaped tops. Such blocks with V-shaped web tops may provide benefits relative to water drainage, aesthetics and other things.

Face blocks 16 and other such blocks can be made of concrete and virtually any other desired material that will provide adequate strength and weather resistance and, importantly, other desired aesthetic qualities. For instance, face blocks may be made of marble or another natural stone, a wide variety of castable or moldable materials, metals (including aluminum), wood and other machinable or formable materials.

Insulation blocks 18 may be married to blocks 14 and 16 using adhesives or other means, and adhesives can act as lubricants to facilitate assembly of the face insulation and structural blocks. Among other alternatives, when adhesive is used, 3M brand Polystyrene Foam 78 Adhesive may be used. Other adhesives may also be used provided that they do not damage the insulation blocks 18 and otherwise provide appropriate application and performance properties.

Insulation blocks 18 are designed to make use of adhesives unnecessary. The blocks of this invention may be joined simply by sliding the tails or keys 60 and 62 of insulation blocks 18 into the grooves or slots 24 and 26 of blocks 14 and the grooves or slots 30 and 32 of face blocks 16. Sloping ramps 64 and 68 may facilitate introduction of the tails or keys 60 and 62 into the grooves or slots of blocks 14 and 16. Whether adhesive is used or not, a hydraulic or other press may be used to facilitate this assembly: (a) by pressing the top 50 of insulation block 18 and bottom 36 of block 14 until the tails 60 and 62 are seated in the grooves 24 and 26 of block 14, and (b) by pressing the top of 38 of facing block 16 and bottom of insulation block 18 until the tails 60 and 62 of block 18 are seated in the grooves 30 and 32 of facing block 16. This assembly may be done in any desired order of steps, including simultaneously.

The desired relative positions of the blocks will be maintained under normal circumstances as a result of friction between rub ribs 88 (visible in FIG. 25 and that protrude from and extend up and down the sloping walls 82 of the tails or keys) and the sloping walls 76 of the groove or slot in the structural block 14 or face block 16 as the case may be. As noted above, adhesive may be used to facilitate assembly and secure the assembled block components to each other. Other numbers, shapes, sizes, and locations of rub ribs than those depicted in the drawings may be used. For example, rub ribs could comprise one or more bumps protruding anywhere from the tails or keys 60 and 62.

The use of sloping ramps 70 on face block 16, sloping ramps 64 on insulation block 18 and sloping ramps 68 on structural block 14 provide the capacity to align insulation block 18 relative to the face block 16 in structural block 14 more accurately than might be the case using other stopping structures. This is because the opposing faces will "lock up" within a small range of relative positions rather than providing a hard stop as might be the case if stop structures square to the block faces were used. These sloping surfaces also provide better encouragement (than would square ledges) for water to drain down within the wall structure.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

For instance, anchors 20 can be configured in numerous other shapes and of different materials, including various different cross sectional sheet metal and wire shapes and sizes. Alternatives to anchors 20 with round end structures having a diameter just less than the width of the tails or keys 62 at the location where the end structures will be imbedded in the tails 62 may be well-suited for their purpose because, among other reasons, they can be rotated along their longitudinal axis during positioning and molding of insulation blocks 18, making them easy to position and use. Other alternative anchor shapes may also be used, including, for instance, anchors having vertically oriented, plate-shaped square or rectangular ends of appropriate width, which ends may be joined by a sheet or web of metal or another material. Similarly, an anchor may be made of cast metal with a central, rectangular web and flaring, dovetail-shaped ends embedded in the tails or keys 62 similar in shape to the anchors 20 depicted in the drawings. Among other wires usable for anchors are 0.15" diameter round galvanized steel wire. Various other wire-making materials can also be used, including, for instance, stainless steel in particularly corrosive environments.

As is indicated in FIGS. 14, 23 and 24, anchors 20 are positioned within the insulation block 18 mold so that one will be located within with one of its ends in each of the opposing the stopped tails or keys 62 near the ends of insulation blocks 18 and centered top to bottom within the insulation block 18. Thus, in the examples of standard stretcher assemblies 12 depicted in the drawings, two anchors 20 attach each facing block 16 to one structural block 14.

Other numbers of grooves and tails in blocks 14, 16 and 18 can be used than the number depicted in the drawings and described above, and different numbers of anchors 20 can be utilized than the number depicted in the drawings and described above.

Appropriate adjustments and configurations may also be desirable in producing the special-purpose sub-assemblies of this invention. For instance, insulation block 172 used with the half-sash units illustrated in FIGS. 4 and 5 may be produced by wire cutting out a central region of the insulation block 18 of appropriate width. The two insulation block ends can then be adhesively bonded together to result in a half-sash insulation block 172 containing the two anchors 20 that were in insulation block 18 and the same length as the half sash structural blocks 166.

One aspect of this disclosure includes four main components: a facing block, a structural block, anchors that prevent the facing from separating from the structural block and insulation between the facing block and the structural block. Most of the detailed description and figures contemplate structures in which anchors are embedded in the insulation blocks and are normally thermally insulated from the face and structural blocks so that the anchors do not form a thermal bridge. Other alternatives are possible. For instance the anchors may be separate components from the insulation that are assembled on site or are preassembled with one or more of the insulation, facing or structural components before those components or subassemblies of those components are assembled on site. Furthermore, anchors, facing blocks and structural blocks could be preassembled or assembled on site so that there is a cavity between the facing and structural blocks into which insulation can be installed in solid form or inserted as a liquid that may foam, and in any event solidifies, in situ. Such alternative anchors may be mounted in either or both of the facing and structural blocks and engaged with the other of these blocks during assembly of the components. In another alternative, an anchor component may be attached to each of the facing and structural blocks and then coupled during component assembly.

Block assemblies may be manufactured with a structural block with a vertical side penetrated by at least one groove, a facing block with a vertical side penetrated by at least one groove, an insulation block With front and back vertical sides, With the front side comprising at least one upward facing tail or key and the back side comprising at least one downward facing tail or key, by performing the following steps, in no particular order: sliding the structural block and insulation blocks relative to each other so that the downward facing tails or keys are received in the structural block grooves, and sliding the facing block and insulation block relative to each other so that the upward facing tails or keys are received in the facing block grooves. The blocks may be pressed together with a press.

Insulation blocks may be manufactured by:

a. providing a mold containing a cavity in the shape of the desired insulation block,
b. providing at least a first anchor,
c. positioning the first anchor within the mold at a location corresponding to a desired anchor location in the insulation block,
d. charging the mold with insulation-forming material,
e. permitting the insulation-forming material to cure, and
f. removing the cured insulation block containing the anchor from the mold.

The mold may include at least one magnet or other structure, and may include multiple magnets or other structures, for holding one or more anchors inn position during the manufacturing process.

A structural block for use at an end, corner or the like in a block wall including structural blocks, insulation blocks and face blocks, each of which face blocks has at least one elongated groove, and each of which insulation blocks has at least one elongated tail or key, may comprise: a concrete masonry unit having a front vertical wall, a back vertical wall and two vertical end walls between the front vertical and back vertical walls, the front and one of the end the walls further comprising at least one vertically extending groove adapted to receive the at least one elongated tail or key.

A facing block for use at a corner, end or the like in a block structure comprising structural blocks, insulation blocks and face blocks, each of which structural blocks has at least one elongated groove, and each of which insulation blocks has at least two elongated tails or keys, may comprise:

a. an L-shaped decorative material comprising:
   i. a front face,
   ii. an end face,
   iii. a back face and
   iv. an end inside face, and
b. each of the back face and the end inside face further comprising at least one vertically extending groove or slot adapted to receive one of the insulation block tails or keys.

A thermally insulated wall structure may include structure blocks, face blocks, anchors for joining the face blocks to the structure blocks, and insulation for interposition between the structure blocks and the face blocks. The anchors may be configured to avoid providing thermal bridges.

That which is claimed is:

1. A block system, comprising:

a. a plurality of structural blocks, each structural block comprising at least one receptacle, a first vertical wall, a second vertical wall spaced apart from the first vertical wall, and at least one web connecting the second vertical wall to the first vertical wall,
b. a plurality of face blocks, each face block comprising at least one receptacle,
c. a plurality of insulation blocks positioned between the plurality of structural blocks and the plurality of face blocks, each insulation block having a multiplicity of vertical water management grooves,
d. a plurality of anchors positioned between the plurality of structural blocks and the plurality of face blocks, and
e. at least one gasket positioned between courses of the plurality of insulation blocks, wherein the at least one gasket forms a barrier to vertical heat transmission between the courses while allowing water to vertically transmit through the at least one gasket between the courses to the vertical water management grooves in the plurality of insulation blocks,
f. wherein a vertical downward movement of the plurality of face blocks causes the protrusions of the plurality of anchors to engage with the at least one receptacle in each of the plurality of structural blocks and the at least one receptacle in each of the plurality of face blocks and tether the plurality of face blocks to the plurality of structural blocks.

2. The block system of claim 1, wherein the first vertical wall, the second vertical wall, and the at least one web of each structural block comprise a combined thickness that is greater than a thickness of each face block.

3. The block system of claim 1, wherein two of the plurality of anchors are embedded in one of the plurality of insulation blocks.

4. The block system of claim 1, wherein each anchor comprises sheet metal.

5. The block system of claim 1, wherein each anchor comprises a first protrusion positioned within the at least one receptacle of one of the plurality of structural blocks, and a second protrusion positioned within the at least receptacle of one of the plurality of face blocks, wherein cross-sectional shapes of the protrusions and receptacles are generally that of a dovetail.

6. The block system of claim 5, wherein each protrusion further comprises at least one protruding rub rib.

7. The block system of claim 6, wherein each protrusion further comprises two protruding rub ribs.

8. The block system of claim 5, wherein a leading end of each protrusion is sloping.

9. The block system of claim 8, wherein each receptacle comprises a stop, wherein the stop comprises a sloping surface.

10. The block system of claim 1, wherein each structural block comprises concrete.

11. The block system of claim 1, wherein each insulation block comprises polystyrene foam.

12. The block system of claim 1, wherein each insulation block comprises polystyrene foam with graphite.

13. The block system of claim 1, wherein portions of the plurality of insulation blocks lap end to end.

14. The block system of claim 1, wherein a top and a bottom of each insulation block comprises grooves.

15. A block system, comprising:

a plurality of structural blocks, each structural block comprising a first vertical wall, a second vertical wall spaced apart from the first vertical wall, and at least one web connecting the second vertical wall to the first vertical wall, a plurality of face blocks, a plurality of insulation blocks positioned between the plurality of structural blocks and the plurality of face blocks, each insulation block having a multiplicity of vertical water management grooves, a plurality of anchors positioned within the plurality of insulation blocks, at least one gasket positioned between courses of the plurality of insulation blocks, wherein the at least one gasket forms a barrier to vertical heat transmission between the courses while allowing water to vertically transmit through the at least one gasket between the courses to the vertical water management grooves in the plurality of insulation blocks, wherein the plurality of anchors do not form a thermal bridge between the plurality of structural blocks and the plurality of face blocks.

16. The block system of claim 15, wherein each anchor comprises a protrusion at each end, each structural block comprises at least one receptacle having an open end facing in a first direction, and each face block comprises at least one receptacle having an open end facing in an opposing direction, wherein the protrusions are positioned within the receptacles.

17. The block system of claim 16, wherein each receptacle comprises a stop, wherein a vertical downward movement of the plurality of face blocks causes the protrusions of the plurality of anchors to engage with the stop in the at least one receptacle in each of the plurality of structural blocks and the at least one receptacle in each of the plurality of face blocks and tether the plurality of face blocks to the plurality of structural blocks.

18. The block system of claim 16, wherein the protrusions and the receptacles each have a dovetail shape.

19. The block system of claim 15, wherein two of the plurality of anchors are embedded in one of the plurality of insulation blocks.

20. The block system of claim 15, wherein each anchor comprises sheet metal.

21. The block system of claim 15, wherein each structural block comprises concrete.

22. The block system of claim 15, wherein each insulation block comprises polystyrene foam.

23. The block system of claim 15, wherein each insulation block comprises polystyrene foam with graphite.

24. The block system of claim 15, wherein portions of the plurality of insulation blocks lap end to end.

25. A block system, comprising:

a plurality of structural blocks, each structural block comprising at least one receptacle having an open end facing in a first direction, a first vertical wall, a second vertical wall spaced apart from the first vertical wall, and at least one web connecting the second vertical wall to the first vertical wall, a plurality of face blocks, each face block comprising at least one receptacle having an open end facing in an opposing direction, a plurality of insulation blocks positioned between the plurality of structural blocks and the plurality of face blocks, each insulation block having a multiplicity of vertical water management grooves, a plurality of anchors positioned within the plurality of insulation blocks, wherein each anchor comprises a first protrusion positioned within the at least one receptacle of one of the plurality of structural blocks, and a second protrusion positioned within the at least receptacle of one of the plurality of face blocks, and at least one gasket positioned between courses of the plurality of insulation blocks, wherein the at least one gasket forms a barrier to vertical heat transmission between the courses while allowing water to vertically transmit through the at least one gasket between the courses to the vertical water management grooves in the plurality of insulation blocks.

26. The block system of claim 25, wherein portions of the plurality of insulation blocks lap end to end.

27. A block system, comprising:

a plurality of structural blocks, each structural block comprising at least one receptacle having a stop a first vertical wall, a second vertical wall spaced apart from the first vertical wall, and at least one web connecting the second vertical wall to the first vertical wall, a plurality of face blocks, each face block comprising at least one receptacle having a stop, a plurality of insulation blocks positioned between the plurality of structural blocks and the plurality of face blocks, each insulation block having a multiplicity of vertical water management grooves, a plurality of anchors positioned within the plurality of insulation blocks, wherein each anchor comprises a first protrusion positioned within the at least one receptacle of one of the plurality of structural blocks, and a second protrusion positioned within the at least receptacle of one of the plurality of face blocks, and at least one gasket positioned between courses of the plurality of insulation blocks, wherein the at least one gasket forms a barrier to vertical heat transmission between the courses while allowing water to vertically transmit through the at least one gasket between the courses to the vertical water management grooves in the plurality of insulation blocks, wherein the plurality of anchors do not form a thermal bridge between the plurality of structural blocks and the plurality of face blocks while the plurality of insulation blocks are positioned between the plurality of structural blocks and the plurality of face blocks, wherein a vertical downward movement of the plurality of face blocks causes the protrusions of the plurality of anchors to engage with the stop in the at least one receptacle in each of the plurality of structural blocks and the at least one receptacle in each of the plurality of face blocks and tether the plurality of face blocks to the plurality of structural blocks.

28. The block system of claim 27, wherein portions of the plurality of insulation blocks lap end to end.

* * * * *